US007106992B2

(12) United States Patent
Ishii et al.

(10) Patent No.: US 7,106,992 B2
(45) Date of Patent: Sep. 12, 2006

(54) PROCESS DEVICE, PHOTOSENSITIVE BODY CARTRIDGE, PHOTOSENSITIVE BODY CARTRIDGE ASSEMBLING METHOD, AND IMAGE FORMING APPARATUS

(75) Inventors: Makoto Ishii, Nagoya (JP); Tsutomu Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/885,615

(22) Filed: Jul. 8, 2004

(65) Prior Publication Data

US 2005/0008394 A1 Jan. 13, 2005

(30) Foreign Application Priority Data

Jul. 9, 2003 (JP) ..... 2003-193981
Jul. 9, 2003 (JP) ..... 2003-193982

(51) Int. Cl.
*G03G 21/16* (2006.01)

(52) U.S. Cl. ..... 399/111

(58) Field of Classification Search ..... 399/102, 399/105, 107, 111, 113
See application file for complete search history.

(56) References Cited

U.S. PATENT DOCUMENTS 5,809,374 A * 9/1998 Tsuda et al. ..... 399/111
6,041,203 A 3/2000 Suzuki et al.
6,330,410 B1 12/2001 Okabe et al.
6,411,789 B1 6/2002 Okabe et al.
6,546,217 B1 4/2003 Okabe et al.
6,690,903 B1 2/2004 Okabe et al.
2002/0028088 A1 3/2002 Okabe et al.

FOREIGN PATENT DOCUMENTS

EP 0 348 256 A1 12/1989
EP 0 866 387 A2 9/1998
EP 1 217 468 A2 6/2002
JP A 6-35245 2/1994
JP A 6-164161 6/1994
JP A 9-116288 5/1997
JP A 11-202733 7/1999
JP A 2000-267547 9/2000
JP A 2000-324836 11/2000

* cited by examiner

*Primary Examiner*—Hoang Ngo
(74) *Attorney, Agent, or Firm*—Oliff & Berridge, PLC

(57) ABSTRACT

A photosensitive body cartridge detachably attachable to a body of an image forming apparatus has a photosensitive body, a lower frame, and an upper frame that is disposed above and is attachable to the lower frame. The upper frame includes an upper engaging portion that engages the lower frame and the lower frame includes a lower engaging portion that engages the upper frame, and the upper engaging portion and the lower engaging portion extend in directions opposite to each other in a state where the upper frame is attached to the lower frame, and when the upper frame and the lower frame are engaged with each other, the upper engaging portion and the lower engaging portion overlap each other.

30 Claims, 10 Drawing Sheets

PROCESS DEVICE, PHOTOSENSITIVE BODY CARTRIDGE, PHOTOSENSITIVE BODY CARTRIDGE ASSEMBLING METHOD, AND IMAGE FORMING APPARATUS

BACKGROUND OF THE INVENTION

This application claims priority from JP 2003-193981 and JP 2003-193982, both filed on Jul. 9, 2003, the entirety of which is incorporated herein by reference thereto.

1. Field of Invention

The invention relates to a process device, a photosensitive body cartridge, a photosensitive body cartridge assembling method, and an image forming apparatus.

2. Description of Related Art

Conventionally, a drum cartridge having a photosensitive drum is detachably attached to an image forming apparatus, such as a laser beam printer. The drum cartridge includes a lower frame and an upper frame, both of which are made of resin, wherein the upper frame is assembled to the lower frame. The upper frame is provided with a scorotron charging device, and the lower frame is provided with a photosensitive drum that is rotatably supported therein.

The upper frame and the lower frame are commonly assembled to each other by using hooks, which are often used to assemble resin parts to each other. For example, Japanese Laid-Open Patent Publication No. 9-116288 discloses upper and lower frames that are provided with hooks, wherein the upper frame is snapped into a place of the lower frame with a single motion by engaging the hooks with each other.

U.S. Pat. Nos. 6,041,203, 6,330,410, 6,411,789, 6,546,217, and 6,690,903 disclose a conventional image forming apparatus, such as a laser beam printer, to which a process unit is detachably attached, wherein the process unit includes a drum cartridge having a photosensitive drum and a toner cartridge which is accommodated in the drum cartridge and has a developing roller.

As shown in the image forming apparatus in FIG. 10, a process unit 131 is attached to a body frame 133, a shaft 132 of a photosensitive drum 136 provided on the process unit 131 is engaged with guide members 134 provided to inner surfaces of both sides of the body frame 133 and the position of the process unit 131, in a front and rear direction and in an up and down direction, is set with respect to the body frame 133. In addition, both side surfaces of a housing 135 of the process unit 131 in the width direction abut against the respective guide members 134, thereby positioning the process unit 131 in the width direction with respect to the printer frame 133.

SUMMARY OF THE INVENTION

In the drum cartridge disclosed in Japanese Laid-Open Patent Publication No. 9-116288, because the upper frame and the lower frame are assembled to each other by snapping the hooks, the hooks need to be firmly engaged with each other so as not to be easily disengaged from each other due to a shock, such as dropping. However, when the hooks are firmly engaged with each other, it is difficult to disengage the upper frame from the lower frame. If the upper frame is forcefully disengaged from the lower frame, the upper frame and the lower frame may be damaged.

The invention provides a photosensitive body cartridge wherein an upper frame and a lower frame can be easily assembled to and disassembled from each other, an image forming apparatus including the photosensitive drum cartridge, and an assembling method of the photosensitive body cartridge.

According to another aspect of the invention, a photosensitive body cartridge includes a photosensitive body, a lower frame, and an upper frame that is disposed above and is attached to the lower frame. The photosensitive body cartridge is detachably attachable to a body of an image forming apparatus. The upper frame includes an upper engaging portion that engages the lower frame and the lower frame includes a lower engaging portion that engages the upper frame. The upper engaging portion and the lower engaging portion extend in directions opposite each other in a state where the upper frame is attached to the lower frame, and the upper frame and the lower frame are engaged with each other by which the upper engaging portion and the lower engaging portion overlap each other.

With this structure, when the upper frame is assembled to the lower frame, the upper frame and the lower frame are engaged with each other by overlapping the upper engaging portion and the lower engaging portion. When the upper frame is disassembled from the lower frame, the upper frame and the lower frame are disassembled from each other by disengaging the upper engaging portion from the lower engaging portion. By doing so, the upper frame and the lower frame can be easily assembled to and disassembled from each other.

As disclosed in U.S. Pat. Nos. 6,041,203, 6,330410, 6,411,789, 6,546,217, and 6,690,903, when the side surfaces of the housing in the width direction directly abut against the guide members of the body frame, the housing slides over the guide members at the time of attaching and detaching the process unit to and from the printer frame. Thus, the housing is damaged and its appearance is deteriorated. In addition, although recycling of the process unit has recently increased, the damaged process unit is not appropriate for recycling, and thus, the process unit needs to be discarded.

Accordingly, provided is a process device that is prevented from being damaged and can achieve a precise positioning when the process device is attached to and detached from an image forming apparatus body, and an image forming apparatus including the process device.

BRIEF DESCRIPTION OF THE DRAWINGS

Embodiments of the invention will be described in detail with reference to the following figures wherein.

DETAILED DESCRIPTION OF PREFERRED EMBODIMENTS

Figure 1:
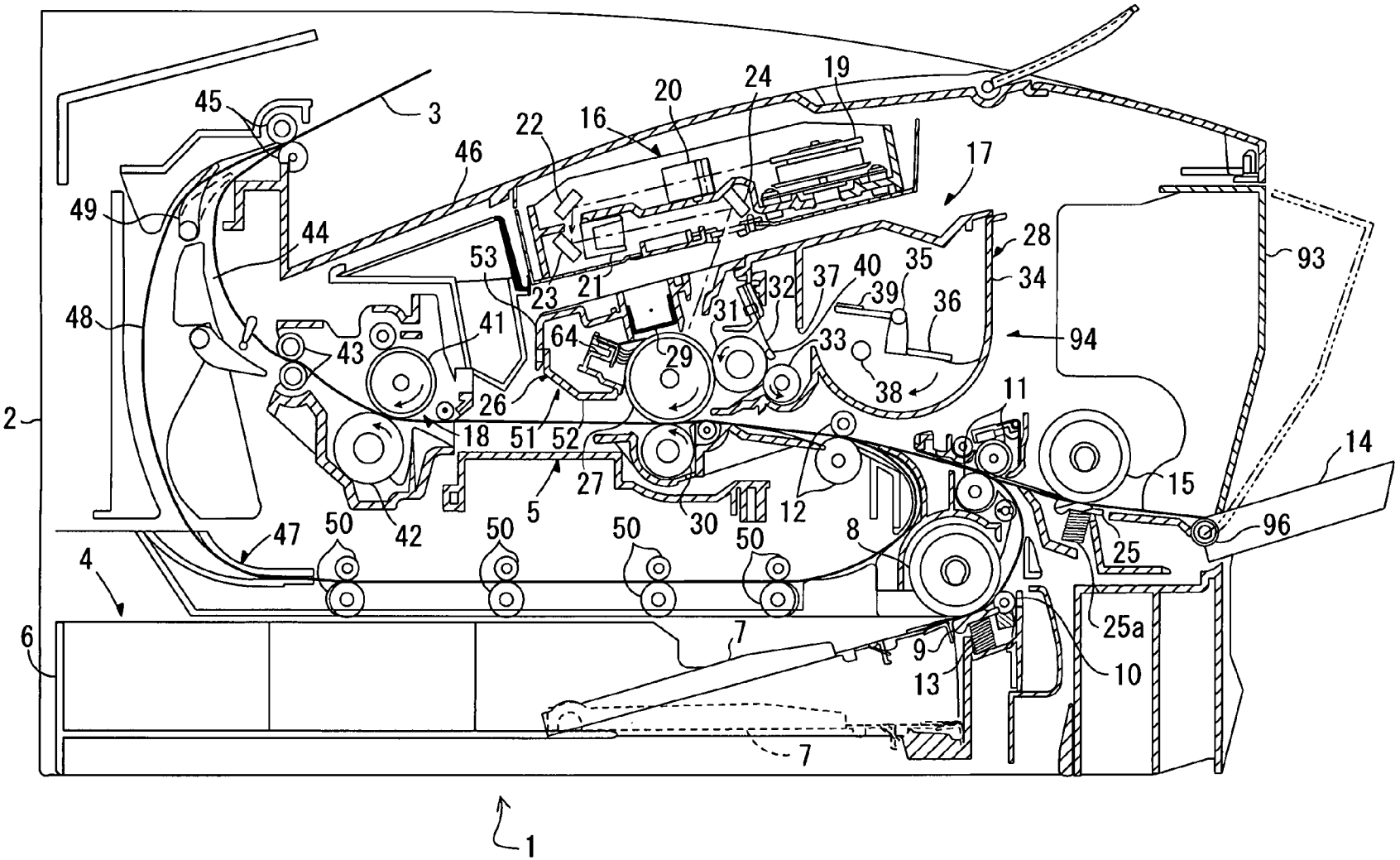
FIG. 1 is a side sectional view showing a laser beam printer as an image forming apparatus of an exemplary embodiment.

Embodiments of the invention will be described with reference to the accompanying drawings. As shown in FIG. 1, a laser beam printer 1 as an image forming apparatus includes a body frame 2 as an image forming apparatus body, a sheet feeding portion 4 that feeds a sheet 3, and an image forming portion 5 that forms an image onto the fed sheet 3. The sheet feeding portion 4 and the image forming portion 5 are provided in the body frame 2.

The feeding portion 4 includes a sheet feeding tray 6, which is detachably attached to the bottom of the body frame 2, a sheet pressing plate 7, which is provided in the sheet feeding tray 6, a sheet supply roller 8 and a sheet supply pad 9, which are disposed at a position above one end of the sheet feeding tray 6 (hereinafter, a side in which the one end of the sheet feeding tray 6 is provided is referred to as the front and a side opposite to the one end is referred to as the rear), paper dust removing rollers 10, 11, which are provided downstream of the sheet supply roller 8 in a sheet conveying direction, and a pair of resist rollers 12, which are provided downstream of the paper dust removing rollers 10, 11 in the sheet conveying direction.

The sheet pressing plate 7 holds a stack of sheets 3 thereon. The sheet pressing plate 7 is swingably supported at an end portion provided on a side far from the sheet supply roller 8 so that the other end portion, provided on a side near the sheet supply roller 8, can move up and down about the far end portion. The sheet pressing plate 7 is upwardly urged by a spring (not shown) from its underside. Therefore, the sheet pressing plate 7 swings downward, against an urging force from the spring, about the far end portion, with increases in the number of sheets 3 stacked. The sheet supply roller 8 and the sheet supply pad 9 are disposed opposite to each other. The sheet supply pad 9 is pressed against the sheet supply roller 8 by a spring 13 provided below the sheet supply pad 9.

A topmost sheet 3 in the stack placed on the sheet pressing plate 7 is pressed against the sheet supply roller 8 by the spring (not shown) from under the sheet pressing plate 7. The topmost sheet 3 is then pinched by the sheet supply roller 8 and the sheet supply pad 9 and is separated and supplied from the stack, one by one, by a rotation of the sheet supply roller 8.

The fed sheet 3 then passes the paper dust removing rollers 10, 11, so that paper dust adhering to the sheet 3 is removed therefrom. After that, the sheet 3 is further conveyed to the resist rollers 12. The resist rollers 12 resist the conveyance of the sheet 3 and then further feed the sheet 3 to an image forming position. The image forming position is referred to as a transfer position at which a toner image formed on a photosensitive drum 27 is transferred onto the sheet 3 and is also referred to as a position at which the photosensitive drum 27 and a transfer roller 30 contact with each other in the embodiment.

The sheet feeding portion 4 further includes a multipurpose tray 14, a multipurpose-side sheet supply roller 15 that supplies a sheet 3 stacked on the multipurpose tray 14, and a multipurpose-side sheet supply pad 25. The multipurpose-side sheet supply roller 15 and the multipurpose-side sheet supply pad 25 are disposed opposite to each other. The multipurpose-side sheet supply pad 25 is pressed against the multipurpose-side sheet supply roller 15 by a spring 25*a* provided below the multipurpose-side sheet supply pad 25.

A topmost sheet 3 in the stack placed on the multipurpose tray 14 is pinched by the multipurpose-side sheet supply roller 15 and the multipurpose-side sheet supply pad 25 and is separated and supplied from the stack, one by one, by a rotation of the multipurpose-side sheet supply roller 15.

The image forming portion 5 includes a scanning portion 16, a process unit 17 as a process device, and a fixing portion 18.

The scanning unit 16 provided at the upper portion of the body frame 2, includes a laser emitting portion (not shown), a rotatable polygon mirror 19, two lenses 20, 21 and three reflectors 22, 23, 24. In the scanning unit 16, a laser beam, which is emitted from the laser emitting portion based on image data, passes or is reflected off the polygon mirror 19, the lens 20, the reflector 22, the reflector 23, the lens 21 and the reflector 24 in this order, and finally is applied to the photosensitive drum 27 by a speedy scanning, as indicated by a dot-dashed line.

The process unit 17 is provided below the scanning unit 16. The process unit 17 includes a drum cartridge 26 as a photosensitive body cartridge and a developing cartridge 28 as a developing agent cartridge. The drum cartridge 26 can be attached to and detached from the body frame 2. The developing cartridge 28 is accommodated in the drum cartridge 26.

The developing cartridge 28 can be attached to and detached from the drum cartridge 26. The developing cartridge 28 includes a developing roller 31 as a developing agent holding member, a layer thickness regulating blade 32, a toner supply roller 33, and a toner hopper 34.

The toner hopper 34 stores positively charged non-magnetic single-component toner, as developing agent. The toner is a polymerized toner obtained through co-polymerization of styrene-based monomers, such as styrene, and acryl-based monomers, such as acrylic acid, alkyl (C1–C4) acrylate, alkyl (C1–C4) methacrylate, using a known polymerization method, such as suspension polymerization. The polymerized toner has a substantially spherical shape and has excellent fluidity. Thus, a high quality image can be formed.

A coloring agent, such as carbon black, and wax are added to the polymerized toner. An external additive, such as silica, is also added to the polymerized toner to improve its fluidity. The particle size of the polymerized toner is approximately 6–10 μm.

The toner stored in the toner hopper 34 is agitated by an agitator 36 supported by a rotating shaft 35 provided in a center portion of the toner hopper 34 and is discharged from a toner discharge port 37 opened in a side portion of the toner hopper 34. The agitator 36 is driven by power from a motor (not shown) so as to rotate (clockwise) in a direction indicated by an arrow in FIG. 1. A toner amount detecting window 38 for checking amount of remaining toner in the toner hopper 34 is provided to both side walls of the toner hopper 34, and is wiped clean by a cleaner 39 supported by the rotating shaft 35.

The toner supply roller 33 is rotatably provided on the side of the toner discharge port 37 of the toner hopper 34. The developing roller 31 is rotatably provided opposite to the toner supply roller 33. The toner supply roller 33 and the developing roller 31 are in contact with each other so that they are press-deformed against each other to an appropriate extent.

The toner supply roller 33 includes a metal roller shaft covered with a roller portion made of a conductive foam material. The toner supply roller 33 is driven by the power from the motor (not shown) so as to rotate (counterclockwise) in a direction indicated by an arrow in FIG. 1.

The developing roller 31 includes a metal roller shaft covered with a roller portion made of a conductive rubber material. More specifically, the roller portion of the developing roller 31 is made of a conductive urethane or silicone rubber containing carbon particles and its surface is covered with a coating layer made of a urethane or silicone rubber containing fluorine. A predetermined developing bias is applied to the developing roller 31 at the time of development. The developing roller 31 is driven by the power from the motor (not shown) so as to rotate (counterclockwise) in a direction indicated by an arrow in FIG. 1.

The layer thickness regulating blade 32 is disposed near the developing roller 31. The layer thickness regulating blade 32 includes a blade body made of a metal leaf spring and a pressing portion 40 made of an insulative silicone rubber. The pressing portion 40 having a semi-circular shape in cross section is provided at a free end of the blade body. The layer thickness regulating blade 32 is situated near the developing roller 31. A base end of the blade body is supported by the developing cartridge 28. The pressing portion 40 provided at the free end of the blade body presses the upper portion of the developing roller 31 by an elastic force of the blade body.

The toner discharged from the toner discharge port 37 is supplied to the developing roller 31 by the rotation of the toner supply roller 33. At that time, the toner is positively charged by friction caused between the toner supply roller 33 and the developing roller 31. The toner supplied onto the developing roller 31 is further supplied between the pressing portion 40 of the layer thickness regulating blade 32 and the developing roller 31 by the rotation of the developing roller 31, so that the toner becomes a thin layer having a uniform thickness and is held on the developing roller 31.

The drum cartridge 26 includes a cartridge frame 51, the photosensitive drum 27 as a photosensitive body provided in the cartridge frame 51, a scorotron charging device 29 as a charging device, the transfer roller 30, and a cleaning brush 64.

Figure 2:
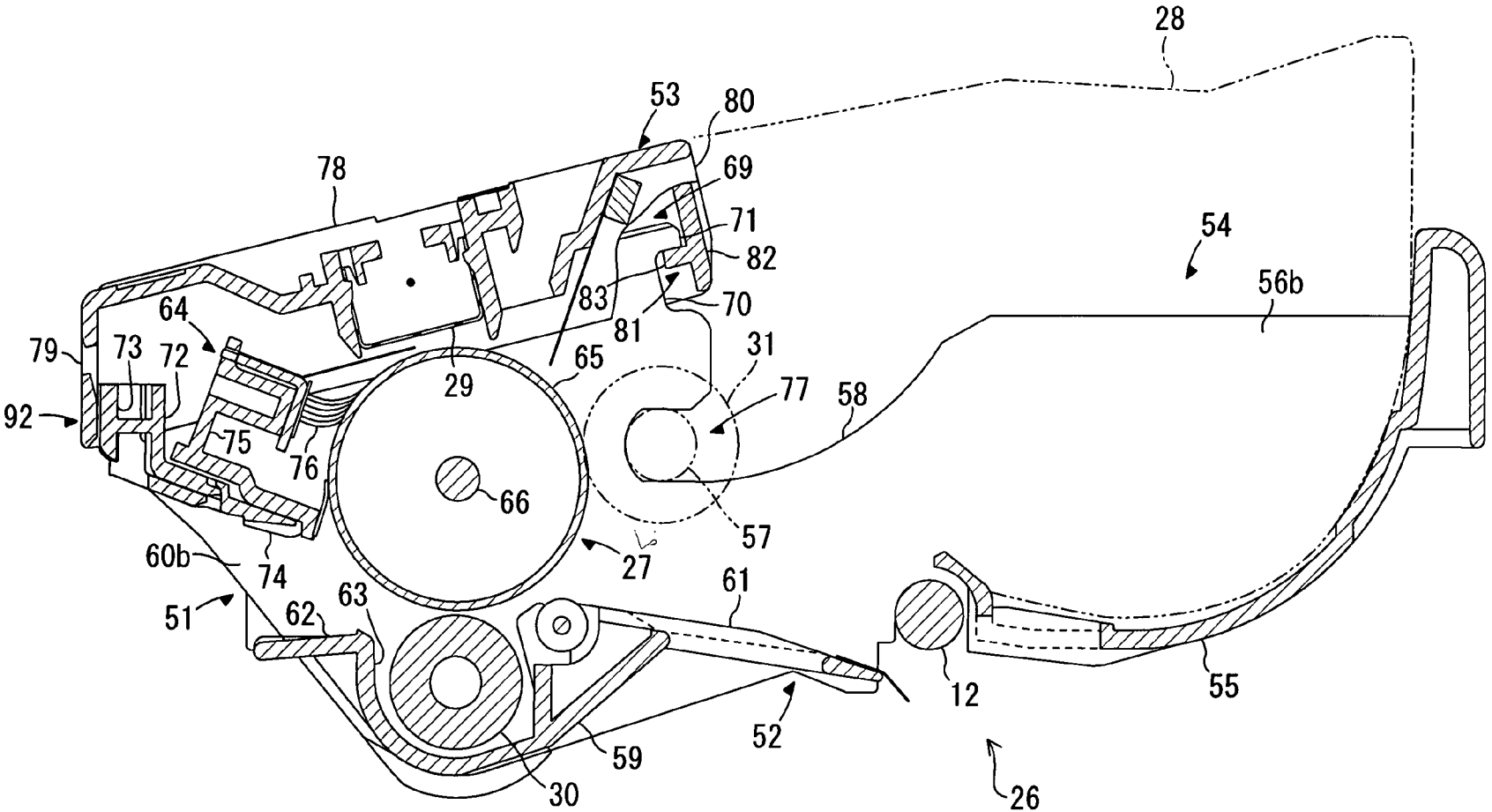
FIG. 2 is a sectional view showing a drum cartridge for the laser beam printer of FIG. 1.

As shown in FIG. 2, the cartridge frame 51 includes a lower frame 52 and an upper frame 53, which is disposed above the lower frame 52 and is attached to the lower frame 52. The lower frame 52 includes a cartridge accommodating portion 54 that accommodates the developing cartridge 28 therein and a drum accommodating portion 77 that accommodates the photosensitive drum 27 and the transfer roller 30 therein. The cartridge accommodating portion 54 and the drum accommodating portion 77 are an integrally connected space.

Figure 5:
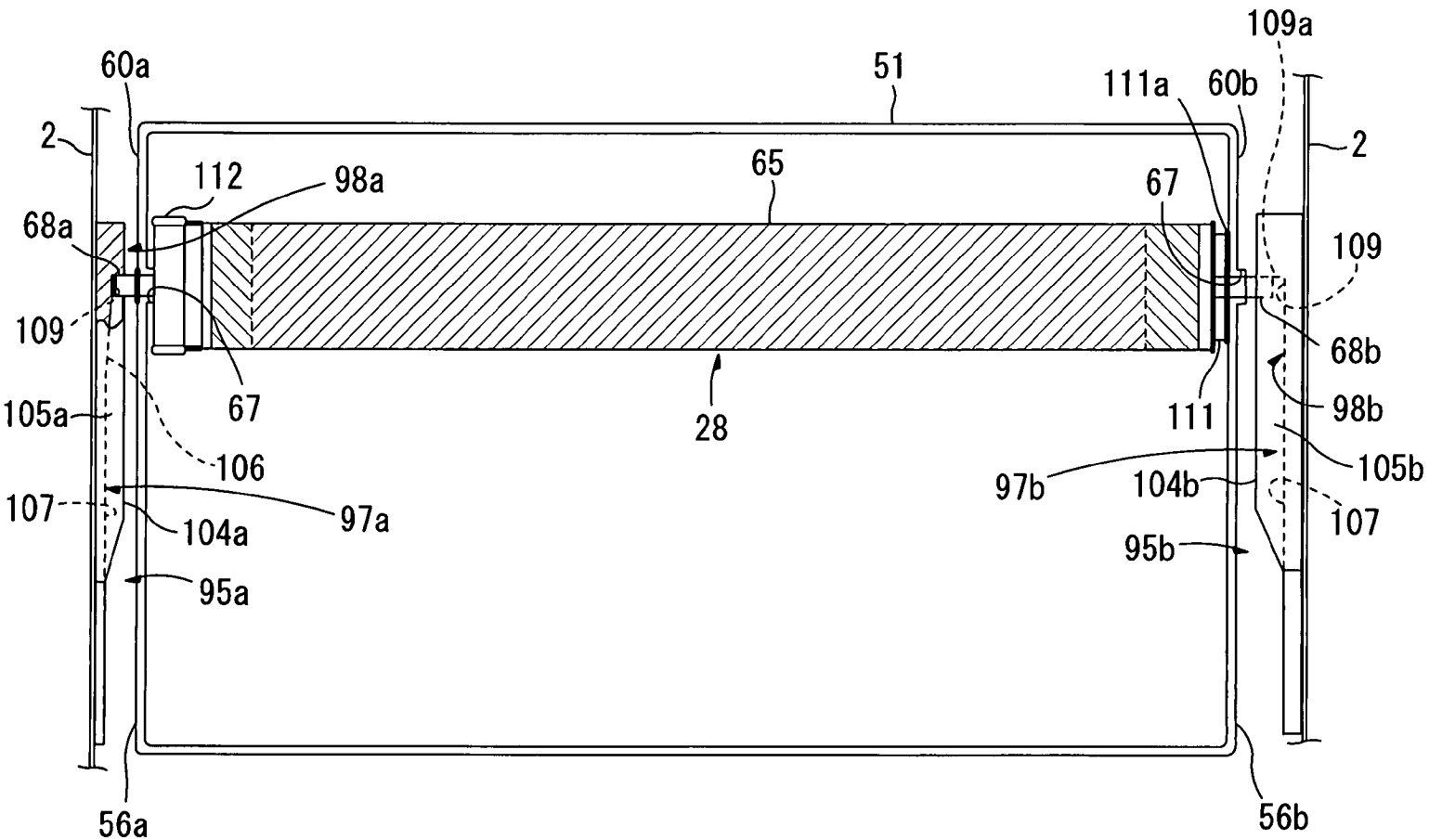
FIG. 5 is a sectional plan view showing essential parts of a body frame of the laser beam printer of FIG. 1 in a state where the drum cartridge of FIG. 2 is attached to the body frame.

The cartridge accommodating portion 54 includes a bottom plate 55 that receives the developing cartridge 28 and left and right developing cartridge side plates 56*a*, 56*b* (the right and left of FIG. 5 are referred to as the right and left) that upwardly extend from left and right side edges of the bottom plate 55 in a width direction, i.e., in a direction perpendicular to the front and rear direction. The side plates 56*a*, 56*b* are integral with the bottom plate 55. The cartridge accommodating portion 54 has a substantially C-shape with upper open structure. The front part of the bottom plate 55 has a curved surface so as to extend along the shape of the developing cartridge 28. The upper resist roller 12 is rotatably supported underneath the bottom plate 55.

A developing cartridge guiding groove 58 is provided in the side plates 56*a*, 56*b*, in order to receive a roller shaft 57 of the developing roller 31, outwardly protruding in the width direction from a housing of the developing cartridge 28. The developing cartridge guiding grooves 58 have a substantially U-shape and extend toward the rear, wherein their upper ends are widely open.

When the developing cartridge 28 is attached to the drum cartridge 26, the roller shaft 57 of the developing roller 31 is received and guided by the developing cartridge guiding grooves 58 and thus is located at the rearmost ends of the developing cartridge guiding grooves 58. In this state, the developing roller 30 and the photosensitive drum 27 are opposingly in contact with each other.

The drum accommodating portion 77 includes a transfer roller receiving portion 59 that receives the transfer roller 30 therein, and left and right drum cartridge side plates 60*a*, 60*b* that are provided on left and right sides of the transfer roller receiving portion 59 in its width direction so as to be opposite to each other. The transfer roller receiving portion 59 and the drum cartridge side plates 60*a*, 60*b* are integrated with each other so as to form a substantially C-shape with upper open structure.

The developing cartridge side plates 56*a*, 56*b* of the cartridge accommodating portion 54 are continuously integral with the side plates 60*a*, 60*b*, respectively, of the drum accommodating portion 77 so that the side plates 56*a* and 60*a* and the side plates 56*b* and 60*b* have continuous flat surfaces without unevenness thereon in the width direction, as shown in FIG. 5.

As shown in FIG. 2, the transfer roller receiving portion 59 includes a front guide plate 61 and a rear guide plate 62 that have a flat-plate shape and extend in the front and rear direction, and a transfer roller accommodating portion 63 that is a downwardly recessed portion provided between the front guide plate 61 and the rear guide plate 62. The front guide plate 61 and the rear guide plate 62 guide the sheet 3 at the front and rear of the transfer position, as will be described later.

The transfer roller 30 is provided in the transfer roller accommodating portion 63 along its width direction. The transfer roller 30 is rotatably supported by the side plates 60*a*, 60*b* provided on the both sides of the transfer roller accommodating portion 63. The transfer roller 30 includes a metal roller shaft covered with a roller portion made of a conductive rubber material. A predetermined transfer bias is applied to the transfer roller 30 at the time of transfer. The transfer roller 30 is driven by the power from a motor (not shown) so as to rotate (counterclockwise) in a direction indicated by an arrow in FIG. 1.

The photosensitive drum 27 is rotatably supported between the side plates 60*a*, 60*b* so as to be opposite to the transfer roller 30 from above. The photosensitive drum 27 includes a cylindrical drum body 65 and a metal drum shaft 66 that is provided at the center of an axis of the drum body 65 to support the drum body 65. In an exemplary embodiment, the drum body 65 includes a base tube made of, for example, aluminum. The base tube is covered with a positively-charged photosensitive layer having polycarbonate.

As shown in FIG. 5, the drum shaft 66 is fixedly supported while being inserted into insertion holes 67 provided in the opposing side plates 60*a*, 60*b*. The drum shaft 66 has left and right shaft end portions 68*a*, 68*b*, which function as a positioning member of the drum shaft 66 on both sides in its axial direction. The shaft end portions 68*a*, 68*b* outwardly protrude in the axial direction from the respective drum cartridge side plates 60*a*, 60*b*. A leaf spring (not shown) is provided between an internal circumferential surface of the drum body 65 and the drum shaft 66 so as to slide relative to the internal circumferential surface when the drum body 65 rotates.

A gear 112 is provided near the shaft end portion 68*a* which is fixed at a fixing portion 98*a* (described later). Power is transmitted to the gear 112 by a drive gear (not shown) provided at the body frame 2. The gear 112 is fixed to the left end of the drum body 65 and disposed between the side plate 60*a* and the drum body 65 in a state where the photosensitive drum 27 is supported between the side plates 60*a* and 60*b*. With this structure, power is transmitted to the gear 112 from the drive gear (not shown) and the drum body 65 of the photosensitive drum 27 rotates (clockwise) in a direction indicated by an arrow in FIG. 1. The drive gear and the gear 112 are both helical gears. By engaging the drive gear with the gear 112, an urging force to urge the drum body 65 toward the side plate 60*a* is generated.

The shaft end portion 68*b* is provided with a cylindrical friction member 111 made of resin. The friction member 111 is press-fitted to the right end of the drum body 65 and is disposed between the side plate 60*b* and the drum body 65 in a state where the photosensitive drum 27 is supported between the side plates 60*a* and 60*b*. The friction member 111 integrally rotates with the drum body 65. In a state where the process unit 17 is attached to the body frame 2, the friction member 111 elastically contacts the side plate 60*b* when pressed from the shaft end portion 60*a* side.

A felt member 111*a*, which rubs the friction member 111, is provided to the side plate 60*b* facing the friction member 111. The felt member 111*a* is made of a felt which is impregnated with grease as necessary. When the drum body 65 rotates, the friction member 111 and the felt member 111*a* rub together, so that the drum body 65 can smoothly rotate. Thus, deformation of the drum body 65, scratching of the side plate 60*b*, and unusual noises can be prevented.

As shown in FIG. 2, a lower engaging portion 69 is provided to an upper front end portion of each drum cartridge side plate 60*a*, 60*b* in order to engage the upper frame 53. Each lower engaging portion 69 has a substantially L-shape, and includes a vertical plate portion 70 that extends upward from an upper end of each drum cartridge side plate 60*a*, 60*b* and a vertical plate protrusion 71 that extends forward from the upper end of the vertical plate portion 70. The vertical plate portion 70 and the protrusion 71 are integral with each other.

A screw fastening portion 72 is provided to the upper rear end portion of each drum cartridge side plate 60*a*, 60*b*. The screw fastening portions 72 protrude inward in the width direction of the drum accommodating portion 77. Each screw fastening portion 72 includes a substantially-recessed screwed portion 73 into which a threaded portion 90 of a shoulder screw 88 (described later) is screwed.

A brush support plate 74 is integrally provided to the lower front end portion of each screw fastening portion 72 so as to extend forward and downward in a slanting direction. A cleaning brush 64 is provided to the brush support plates 74.

The cleaning brush 64 includes a brush holder 75 and a brush 76. The brush holder 75 is provided so as to extend between the brush support plates 74. The brush 76 is provided to the brush holder 75 so as to be opposite to and contact the drum body 65 of the photosensitive drum 27.

As shown in FIG. 2, the upper frame 53 includes an upper plate 78 that covers the upper portion of the drum accommodating portion 77 of the lower frame 52, a rear plate 79 that extends downward from a rear edge of the upper plate 78, a front plate 80 that extends downward from a front edge of the upper plate 78. The upper plate 78, the rear plate 79, and the front plate 80 are integral with each other.

The scorotron charging device 29 is provided at the middle in the front and rear direction of the upper plate 78 so as to extend in the width direction of the upper plate 78 and be opposite to the photosensitive drum 27 at a predetermined distance away from each other. The scorotron charging device 29 is located above the photosensitive drum 27 so as to be opposite to the photosensitive drum 27 at the predetermined distance away from each other in a state where the upper frame 53 is attached to the lower frame 52. The scorotron charging device 29 is a charging device that generates corona discharge from charging wires, such as tungsten wires, in order to uniformly positively charge the surface of the photosensitive drum 27.

An upper engaging portion 81 is provided to each side of the front end of the upper plate 78 in the width direction. Each upper engaging portion 81 has a substantially T-shape, and includes a vertical bar portion 82 that extends downward along the front plate 80 and an upper engaging protrusion 83 that extends rearward from the middle portion of the vertical bar portion 82 in the up and down direction. The vertical bar portion 82 and the protrusion 83 are integral with each other.

The upper engaging portion and the lower engaging portion may extend in the direction parallel to a direction to attach the photosensitive body cartridge in a state where the upper frame is attached to the lower frame.

According to the above structure, the upper engaging portion and the lower engaging portion overlap each other in the direction parallel to the direction to attach the photosensitive body cartridge. Therefore, the upper frame and lower frame can be prevented from disengaging from each other in the direction parallel to the photosensitive body cartridge attaching direction.

The upper engaging portion may have a protrusion integrated therewith, and the lower engaging portion may have a protrusion integrated therewith. The upper frame and the lower frame are engaged with each other by which the protrusion of the upper engaging portion and the protrusion of the lower engaging portion overlap each other.

According to the above structure, the upper frame and the lower frame are engaged with each other by which the protrusion of the upper engaging portion and the protrusion of the lower engaging portion overlap each other. Therefore, the upper frame and the lower frame can be firmly engaged with each other.

The lower frame may be provided with the protrusion at each side in the longitudinal direction of the photosensitive body and the upper frame may be provided with the protrusion at a position corresponding to each of the protrusions of the lower frame.

With this structure, the protrusion of the lower engaging portion and the protrusion of the upper engaging portion overlap each other on each side of the photosensitive body in its longitudinal direction. Therefore, the upper frame and the lower frame can be firmly engaged with each other.

The protrusions of the lower and upper frames may be provided at one side of the photosensitive body cartridge in a direction perpendicular to the longitudinal direction of the photosensitive body.

With this structure, the protrusions of the lower and upper frames can overlap each other at the one side of the photosensitive body cartridge in the direction perpendicular to the longitudinal direction of the photosensitive body. Therefore, the engagement of the upper frame and the lower frame can be achieved at the one side of the photosensitive body cartridge in the direction perpendicular to the longitudinal direction of the photosensitive body.

The lower frame and the upper frame may be fixed to each other by a screw, at the other side of the photosensitive body cartridge in the direction perpendicular to in the longitudinal direction of the photosensitive body.

According to the above structure, the lower frame and the upper frame are fixed to each other by a screw, at the other side of the photosensitive body cartridge in the longitudinal direction of the photosensitive body. Therefore, the engagement of the upper frame and the lower frame can be achieved at the both sides of the photosensitive body cartridge in the direction perpendicular to the longitudinal direction.

The screw may include a head portion to which a rotating force is applied, a threaded portion that is provided with threads, and a shoulder portion that is provided between the head portion and the threaded portion and has a diameter which is larger than that of the threaded portion and is smaller than that of the head portion. One of the lower frame and the upper frame may be provided with a receiving portion that receives the shoulder portion and has the substantially same diameter as the shoulder portion and the other of the lower frame and the upper frame may be provided with a screwed portion into which the threaded portion is screwed.

With this structure, the screw is positioned with substantially no play in a state where the shoulder portion of the screw is received by the receiving portion, so that the screw can be accurately positioned.

The photosensitive body cartridge may further include an overlap portion that is defined by the lower frame and the upper frame at the other side of the photosensitive body cartridge in the direction perpendicular to the longitudinal direction of the photosensitive body, wherein the lower frame and the upper frame overlap each other in the direction perpendicular to the longitudinal direction of the photosensitive body.

With this structure, by the overlap portion, the positioning between the lower frame and the upper frame at the other side of the drum body cartridge can be achieved and foreign matter is prevented from entering the drum body cartridge between the upper frame and the lower frame.

The lower frame and the upper frame may be opposite to each other at the other side of the photosensitive body cartridge in the direction perpendicular to the longitudinal direction of the photosensitive body by which the upper frame is rotated with respect to the lower frame about a contacting portion where a lower surface of the protrusion of the lower frame and an upper surface of the protrusion of the upper frame are contacted with each other.

According to the above structure, in the state where the lower surface of the protrusion of the lower frame and the upper surface of the protrusion of the upper frame are contacted with each other at the one side, the upper frame is rotated with respect to the lower frame about the contacting portion. Then, the upper frame and the lower frame are opposite to each other at the other side. Therefore, the lower frame and the upper frame can be easily and smoothly assembled to each other at the other side.

At least one of the upper frame and the lower frame may be provided with a regulating portion that regulates movement of the protrusion of the lower frame or the upper frame in a direction parallel to the longitudinal direction of the photosensitive body.

With this structure, the regulating portion regulates the protrusion from moving in the direction parallel to the longitudinal direction of the photosensitive body. Therefore, during assembling, the protrusion can be prevented from being displaced in the direction parallel to the longitudinal direction of the photosensitive body. Thus, smooth assembling of the upper frame and the lower frame can be achieved.

The photosensitive drum may be supported by the lower frame. With this structure, the photosensitive body can be firmly supported by the lower frame.

The photosensitive body cartridge may further include a charging device, the charging device being supported by the upper frame. According to the above structure, the charging device is supported by the upper frame, so that the charging device can be assembled by assembling the upper frame to the lower frame.

The lower frame may include a cleaning unit that accommodates a cleaning member for cleaning the photosensitive body, and the cleaning unit may include an urging member that applies an urging force to the upper frame. With this structure, the positioning of the upper frame and the lower frame can be achieved by the urging force from the urging member.

Figure 3:
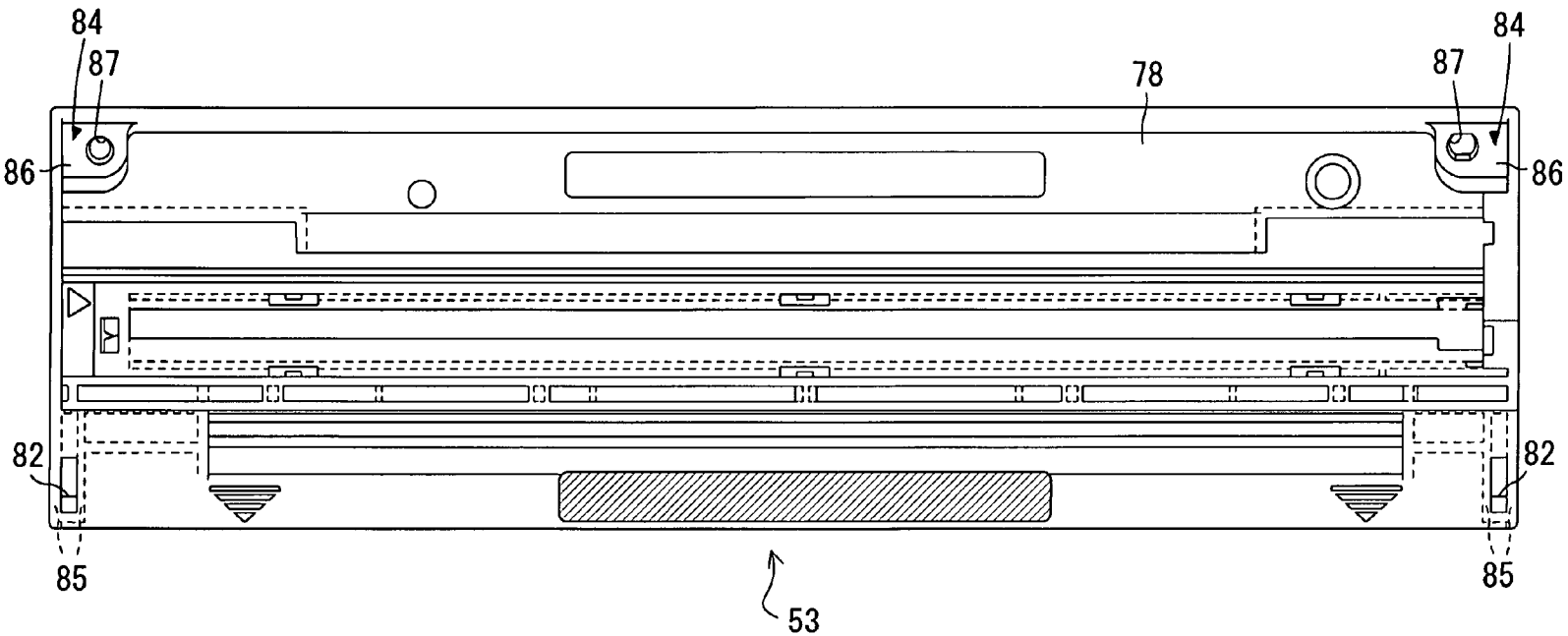
FIG. 3 is a plan view of an upper frame of the drum cartridge of FIG. 2.

As shown in FIG. 3, a pair of regulating plates 85, as a regulating portion, is provided to the both sides of the front end of the upper plate 78 in the width direction in order to pinch the vertical bar portion 82 of the upper engaging portion 81 in the width direction. As described later, the regulating portions 85 regulate misalignment or slide in the width direction in the engagement of the protrusions 71 of the lower engaging portions 69 and the protrusions 83 of the upper engaging portions 81 in a state where the upper frame 53 is attached to the lower frame 52.

A screw mounting portion 84 is provided to each side of the rear end of the upper plate 78 in the width direction. As shown in FIGS. 3 and 4C, each screw mounting portion 84 includes a flat-plate-shaped screw seat portion 86 that receives a head portion 89 of the shoulder screw 88 and a receiving hole 87, as a receiving portion, that is provided in the screw seat portion 86 and has a substantially same diameter as that of a shoulder portion 91 of the shoulder screw 88. Although the recessed screwed portions 73 and the screw seat portions 86 are provided to the lower frame 52 and the upper frame 53, respectively, in this exemplary embodiment, the recessed screwed portions 73 and the screw seat portions 86 may be provided to the upper frame 53 and the lower frame 52, respectively.

According to another aspect of the invention, a method of assembling a photosensitive body cartridge that is detachably attachable to a body of an image forming apparatus and includes a photosensitive body is provided. The photosensitive cartridge includes a lower frame and an upper frame that is disposed above and is attached to the lower frame. The upper frame includes an upper engaging portion engaging the lower frame and the lower frame includes a lower engaging portion engaging the upper frame. The upper frame and the lower frame include protrusions that extend in directions opposite to each other in a state where the upper frame is attached to the lower frame and engage the upper frame with the lower frame by overlapping each other. The method includes contacting a lower surface of the protrusion of the lower frame with an upper surface of the protrusion of the upper frame, rotating the upper frame with respect to the lower frame about a contacting portion where the lower surface of the protrusion of the lower frame contacts the upper surface of the protrusion of the upper frame, and engaging the upper frame with the lower frame at one side of the photosensitive body cartridge in a direction perpendicular to a longitudinal direction the photosensitive body.

According to the above method, in the state where the lower surface of the protrusion of the lower frame and the upper surface of the protrusion of the upper frame are contacted with each other, the upper frame is rotated with respect to the lower frame about the contacting portion. Then, the upper frame and the lower frame are opposite to each other at the one side of the photosensitive body cartridge in the direction perpendicular to the longitudinal direction the photosensitive body. Therefore, the lower frame and the upper frame can be easily and smoothly assembled to each other.

The engaging step may include the step of engaging the upper frame with the lower frame by using the protrusions provided to the other side of the photosensitive body cartridge in a direction perpendicular to the longitudinal direction of the photosensitive body.

According to the above method, the upper frame and the lower frame are engaged with each other by using the protrusions provided to the other side of the photosensitive body cartridge in a direction perpendicular to the longitudinal direction of the photosensitive body. Therefore, the engagement of the upper frame and the lower frame can be achieved at the other side the photosensitive body cartridge in the direction perpendicular to the longitudinal direction of the photosensitive body.

The engaging step may further include the step of fixing the lower frame and the upper frame to each other by a screw at the one side of the photosensitive body cartridge in the direction perpendicular to the longitudinal direction of the photosensitive body.

According to the above method, the lower frame and the upper frame are fixed to each other by a screw, at the other side of the photosensitive body cartridge in the longitudinal direction of the photosensitive body. Therefore, the engagement of the upper frame and the lower frame can be achieved at the both sides of the photosensitive body cartridge in the direction perpendicular to the longitudinal direction.

The upper frame and the lower frame may be fixed to each other by the engagement of the protrusion of the lower frame and the protrusion of the upper frame and the upper frame is positioned with respect to the lower frame by the screw.

According to the above method, the upper frame and the lower frame are fixed to each other by the engagement of the protrusion of the lower frame and the protrusion of the upper frame, and the upper frame is positioned with respect to the lower frame by the screw. Thus, precise assembly can be achieved.

Figure 4A:
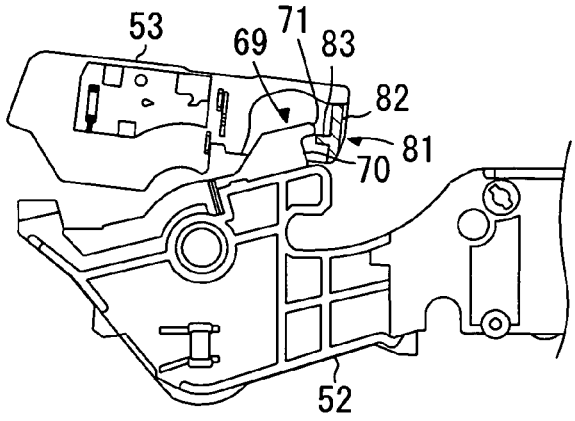
FIG. 4A is an explanatory diagram showing a process of attaching the upper frame to a lower frame in the drum cartridge of FIG. 2, wherein a lower surface of a protrusion of a lower engaging portion of the lower frame and an upper surface of a protrusion of an upper engaging portion of the upper frame are in contact with each other.
Figure 4B:
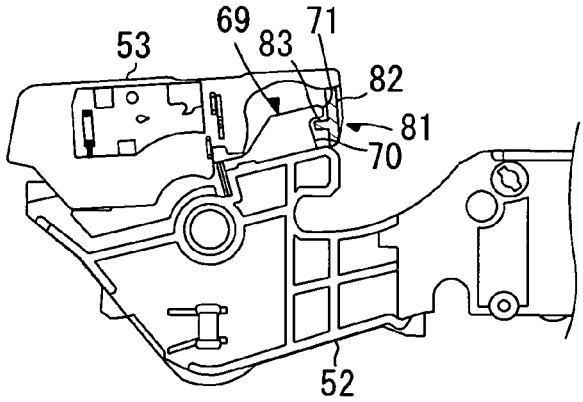
FIG. 4B is an explanatory diagram showing the process of attaching the upper frame to the lower frame in the drum cartridge of FIG. 2, wherein the upper frame is rotated with respect to the lower frame in the state shown in FIG. 4A.
Figure 4C:
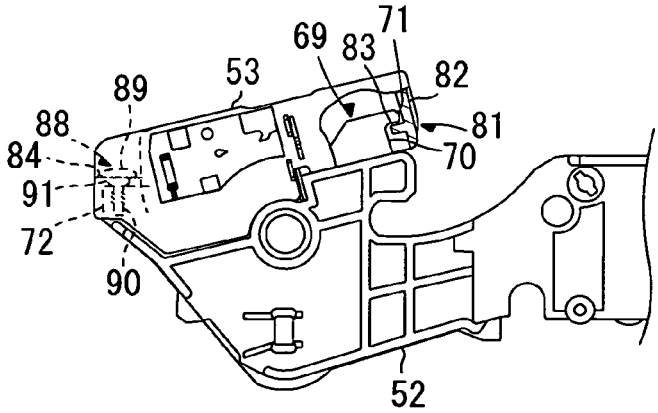
FIG. 4C is an explanatory diagram showing the process of attaching the upper frame to the lower frame in the drum cartridge of FIG. 2, wherein a screw fastening portion of the lower frame are opposingly aligned with a screw mounting portion of the upper frame.

The upper frame 53 is assembled to the lower frame 52 as shown in FIGS. 4A to 4C. That is, as shown in FIG. 4A, first, at the front side, the upper surfaces of the upper engaging protrusions 83 of the upper engaging portions 81 of the upper frame 53 are contacted with the lower surfaces of the vertical plate protrusions 71 of the respective lower engaging portions 69 of the lower frame 52. In this state, the upper frame 53 is rotated with respect to the lower frame 52 about the contacting portion, as shown in FIG. 4B. At the rear side, as shown in FIG. 4C, the screw mounting portions 84 of the upper frame 53 are opposingly aligned with the respective screw fastening portions 72 of the lower frame 52.

The shoulder screws 88 are screwed into the respective screwed portions 73 of the screw fastening portions 72 via the receiving holes 87 of the screw mounting portions 84. Thus, the upper frame 53 is fixed to the lower frame 52 by the shoulder screws 88 and the position of the upper frame 53 is set with respect to the lower frame 52.

More specifically, each shoulder screw 88 includes the head portion 89 to which a rotating force is applied, the threaded portion 90 is provided with threads. The shoulder portion 91 is provided between the head portion 89 and the threaded portion 90 and has a diameter which is larger than that of the threaded portion 90 and smaller than that of the head portion 89. The head portion 89, the threaded portion 90, and the shoulder portion 91 are integral to form a monolithic structure. The threaded portion 90 of the shoulder screw 88 is screwed into the screwed portion 73 by which the rotating force is applied to the head portion 89. Then, the head portion 89 is received by the screw seat portion 86 and the shoulder portion 91 is fitted into the receiving hole 87 with substantially no play.

In the drum cartridge 26, the upper engaging protrusions 83 of the upper engaging portions 81 and the vertical plate protrusions 71 of the lower engaging portions 69 overlap each other, respectively, in the front and rear direction, i.e., in a direction to attach the drum cartridge 26 to the body frame 2, so that the protrusions 83 and 71 extend in the opposite directions, in a state where the upper frame 53 is assembled to the lower frame 52. Therefore, the upper frame 53 and the lower frame 52 are engaged with each other. In the assembled state, overlap portions 92 are defined by which the rear walls of the screw fastening portions 72 of the lower frame 52 and the rear plate 79 of the upper frame 53 overlap each other in the front and rear direction.

The drum cartridge 26, in which the upper frame 53 is assembled to the lower frame 52 as described above, is attached to the body frame 2 and the developing cartridge 28 is accommodated in the cartridge accommodating portion 54. That is, the process unit 17 is attached to the body frame 2.

Next, the attaching operation of the process unit 17 to the body frame 2 will be described.

According to another aspect of the invention, an image forming apparatus includes a process device that is detachably attached to a body of the image forming apparatus. The process device includes a photosensitive body cartridge that is detachably attachable to the body of the image forming apparatus and includes a photosensitive body, and a developing agent cartridge that is detachably attachable to the photosensitive body cartridge and includes a developing agent holding member. The photosensitive body includes a lower frame, and an upper frame that is disposed above and attached to the lower frame. The upper frame includes an upper engaging portion that engages the lower frame and the lower frame includes a lower engaging portion that engages the upper frame. The upper engaging portion and the lower engaging portion include protrusions that extend in directions opposite to each other in a state where the upper frame is attached to the lower frame. The upper frame and the lower frame are engaged with each other by which the protrusions of the upper engaging portion and the protrusion of the lower engaging portion overlap each other.

With this structure, when the upper frame is assembled to the lower frame, the upper frame and the lower frame are engaged with each other by overlapping the upper engaging portion and the lower engaging portion. When the upper frame is disassembled from the lower frame, the upper frame and the lower frame are disassembled from each other by disengaging of the upper engaging portion from the lower engaging portion. By doing so, the upper frame and the lower frame can be easily assembled to and disassembled from each other.

The photosensitive body may include a shaft rotatably supported by the frame, wherein one end of the shaft may function as the positioning member. According to the above structure, one end of the shaft functions as the positioning member, so that a parts count can be reduced and a structure of the image forming apparatus can be simplified. The other end of the shaft may be electrically connected to a ground when the process device is attached to the image forming apparatus body.

According to the above structure, the other end of the shaft is electrically connected to the ground when the process device is attached to the image forming apparatus, so that an electrostatic latent image can be stably formed onto the photosensitive body.

As shown in FIG. 1, the body frame 2 includes a front cover 93, a process unit accommodating portion 94, and left and right guide plates 95*a*, 95*b* (see FIG. 5). The front cover 93 opens and closes to attach and detach the process unit 17 to the body frame 2 therethrough. The process unit accommodating portion 94 is a space defined by the front cover 93 that is open. The left and right guide plates 95*a*, 95*b* (see FIG. 5) as contacting members are provided on the both sides of the process unit accommodating portion 94 in the width direction.

The front cover 93 is rotatably supported by the body frame 2 via a hinge 96 at its lower end so as to cover the front of the body frame 2. The front cover 93 can open toward the front about the hinge 96, as shown in a double dashed chain line. The front cover 93 can rotate between an open position where the process unit accommodating portion 94 is opened and a closed position where the process unit accommodating portion 94 is closed.

As shown in FIG. 5, the guide plates 95*a*, 95*b* are provided on the left and right sides of the body frame 2, respectively, in the width direction of the process unit accommodating portion 94. The guide plate 95*a* includes a side plate 104*a* and a base plate 105*a* that is bent outward in the width direction from an end portion of the side plate 104*a*. The side plate 104*a* and the base plate 105*a* are integral with each other. The side plate 104*a* includes an inclined surface that is inclined from the rear to the front toward the outside. The guide plate 95*b* also includes a side plate 104*b*, a base plate 105*b*, which are the same as the side plate 104*a* and the base plate 105*a*.

Figure 6:
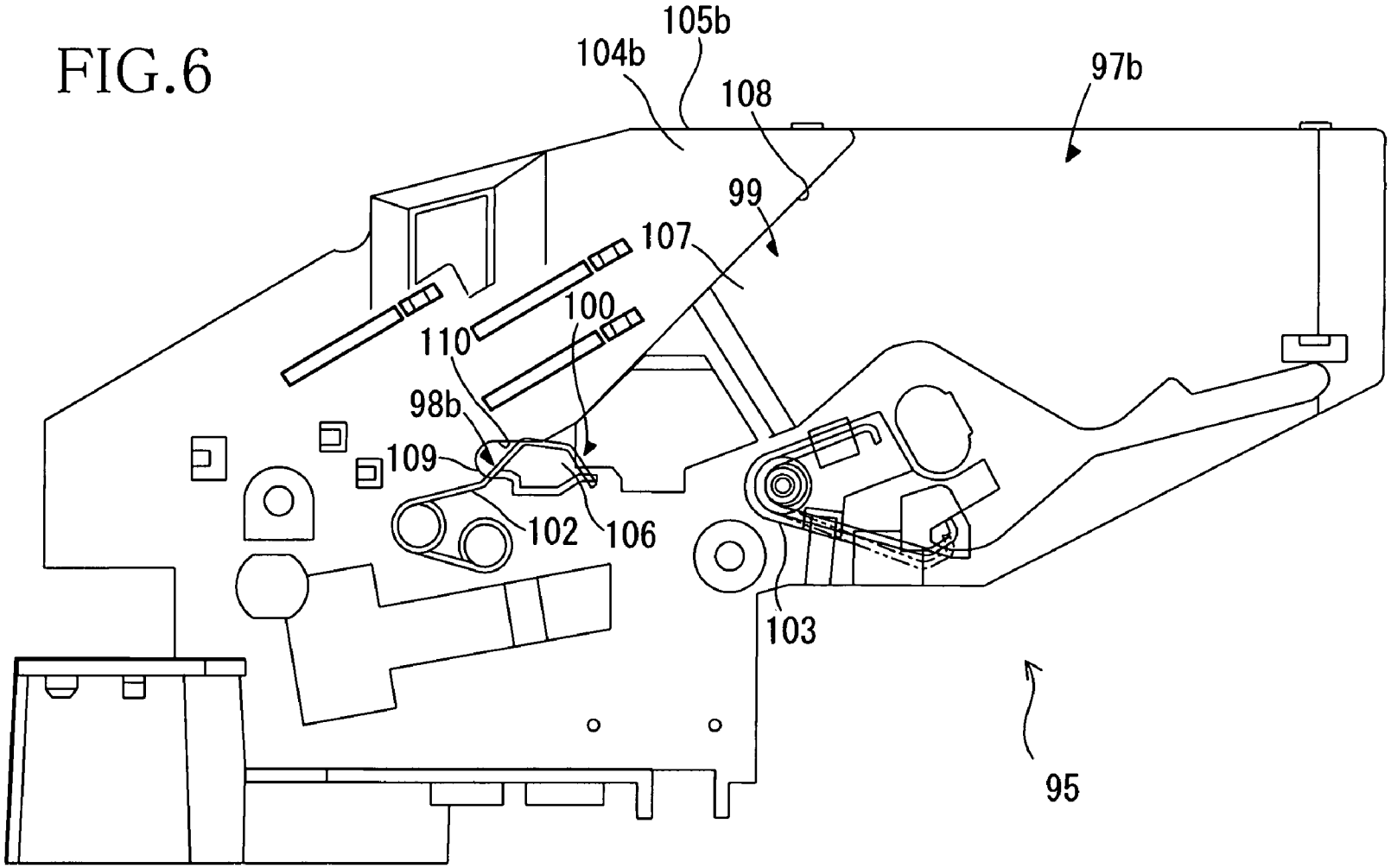
FIG. 6 is a side view of one of guide plates of the body frame of FIG. 5.

As shown in FIG. 6, the side plate 104*b* includes a guide portion 97*b* that guides the drum shaft 66, a fixing portion 98*b* that fixes the drum shaft 66 therein, and a pressing spring 103 that urges the upper resist roller 12 against the lower resist roller 12.

The guide portion 97*b* includes a groove that is recessed toward the outside in the width direction with respect to the side plate 104*b*. More specifically, the guide portion 97*b* includes a guide portion recessed surface 107 and an end face 108 that extends toward the inside in the width direction, from an end of the guide portion recessed surface 107. The guide plate 95*b* is opened from its front end portion to its upper end portion, when viewed from the side. In the guide portion 97*b*, a receiving groove 99 that extends toward the fixing portion 98*b* so that its width is gradually narrow and a positioning groove 100 that extends toward the rear in the front and rear direction from the receiving groove 99 are provided so that the receiving groove 99 continues to the positioning groove 100.

The fixing portion 98*b* is provided at the rear end portion of the positioning groove 100. The fixing portion 98*b* includes a groove that is recessed toward the outside in the width direction with respect to the side plate 104 so as to continue from the positioning groove 100. More particularly, the fixing portion 98*b* includes a recessed surface 109 and an end face 110 that extends toward the inside in the width direction from an end face of the recessed surface 109. The fixing portion 98*b* has a substantially semicircular shape in cross section so that the drum shaft 66 is fitted into the end face 110 with substantially no play. Although FIG. 6 shows the right side only, the side plate 104*a* has the same parts and structure (a guide portion 97*a* including a guide portion recessed surface 107 and an end face 108, a fixing portion 98*a* including a recessed surface 109 and an end face 110).

As shown in FIG. 5, in the guide plate 95*a*, the guide portion recessed surface 107 of the guide portion 97*a* is provided at a position more outside than the position where the recessed surface 109 of the fixing portion 98*a* is present, in the width direction. The guide portion recessed surface 107 of the guide portion 97*a*, which extends to the recessed surface 109 of the fixing portion 98*a*, includes an inclined surface 106 that is inclined toward the inside in the width direction from the front to the fixing portion 98*a* provided at the rear position. In the guide plate 95*b*, the guide portion recessed surface 107 of the guide portion 97*b* and the recessed surface 109 of the fixing portion 98*b* are provided at the same level so as to extend in the same plane.

In the guide plate 95*b*, the recessed surface 109 of the fixing portion 98*b* is provided with a grounding electrode 109*a* used to electrically connect the photosensitive drum 27 to a ground. The grounding electrode 109*a* includes a wire spring and urges the shaft end portion 68*b* of the drum shaft 66 toward the side plate 60*a*.

As shown in FIG. 6, a fixing spring 102 is provided near the fixing portion 98*b* to fix the shaft end portion 68*b* of the drum shaft 66 inserted into the fixing portion 98*b* by pressing the shaft end portion 68*b* against the rear edge of the fixing portion 98*b*. While one end of the fixing spring 102 is fixed to the side plate 104*b*, the other end of the fixing spring 102 urges the shaft end portion 68*b* of the drum shaft 66 inserted into the fixing portion 98*b* against the rear edge of the fixing portion 98*b* while being opposite to the rear edge of the fixing portion 98*b*, in the front and rear direction. Although not shown in the drawings, the fixing spring 102 is also provided near the fixing portion 98*a* in the same condition.

Figure 8:
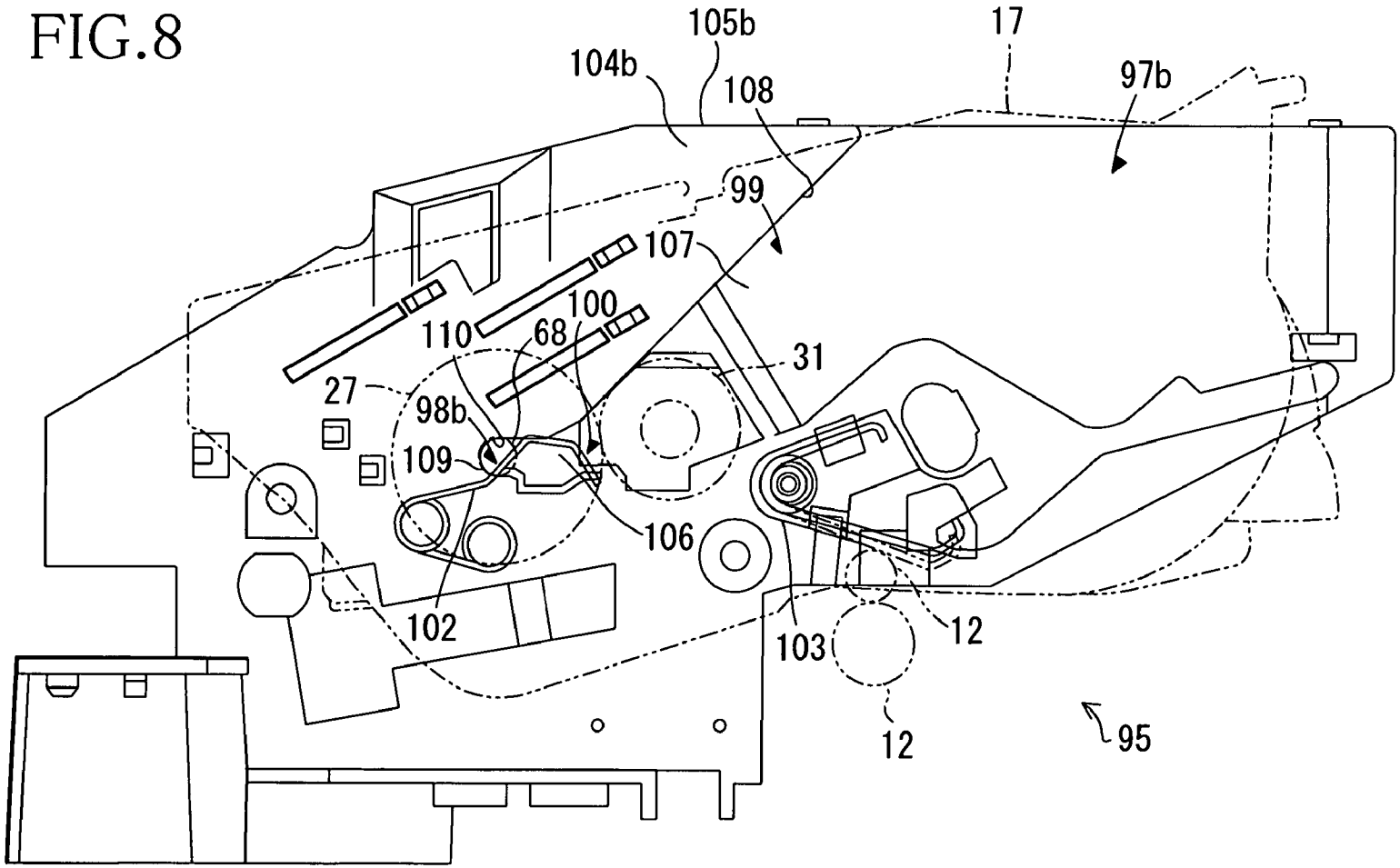
FIG. 8 is a side view of the guide plate of the body frame of FIG. 5 wherein the developing cartridge is attached to the body frame.

The pressing springs 103 are provided below the guide portions 97*a*, 97*b*. As shown in FIG. 8 (the right side only), the pressing springs 103 urge the upper resist roller 12 against the lower resist roller 12 in a state where the upper frame 53 is assembled to the lower frame 52.

Figure 7:
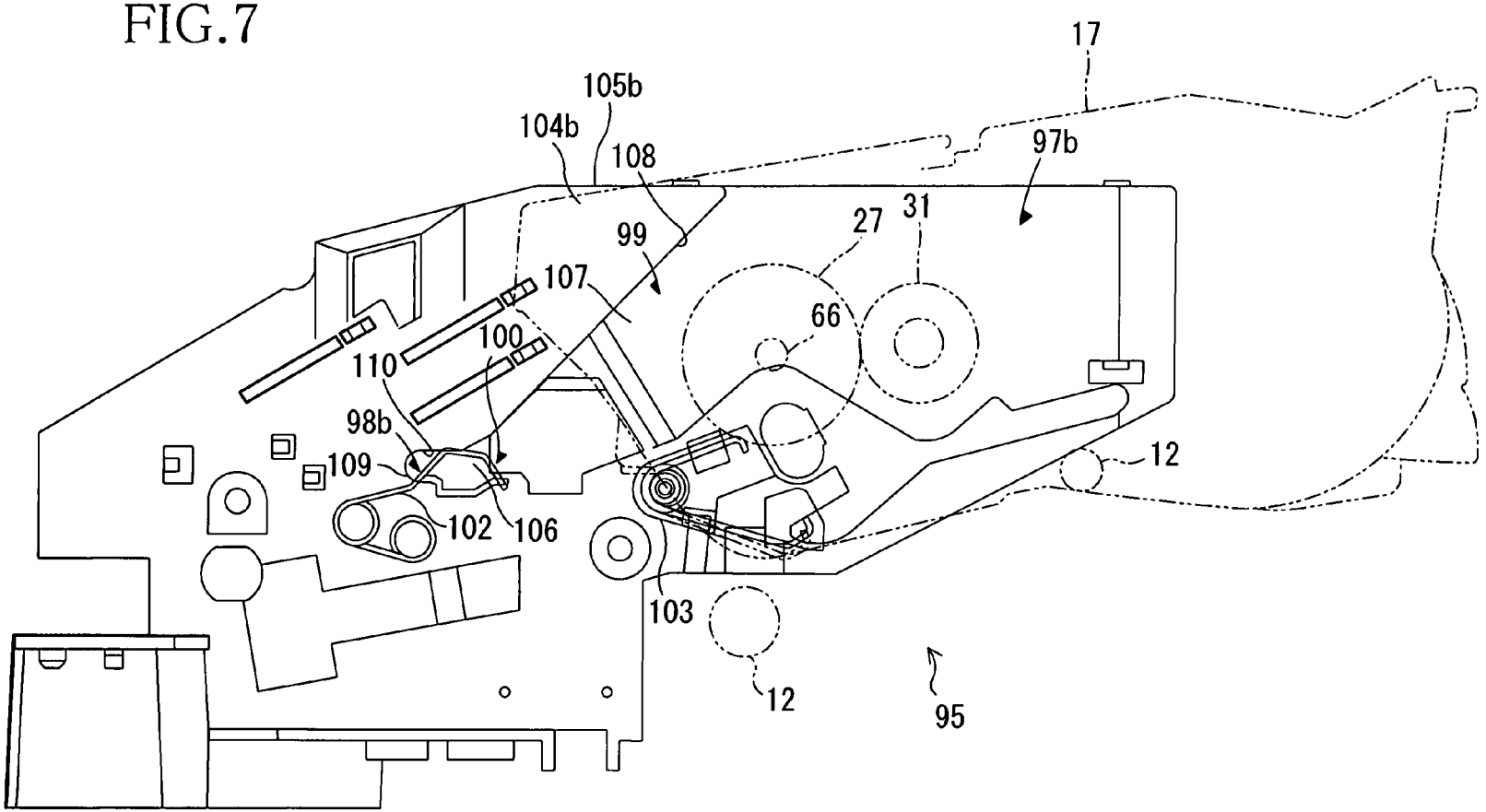
FIG. 7 is a side view of the guide plate of the body frame of FIG. 5 in a process of attaching a developing cartridge to the body frame.

To attach the process unit 17 to the body frame 2, first, the front cover 93 is rotated to the open position to open the process unit accommodating portion 94. The process unit 17 is inserted into the process unit accommodating portion 94 via the opening defined by the front cover 93 that is opened. At that time, as shown in FIG. 7, the shaft end portions 68*a*, 68*b* of the drum shaft 66 of the photosensitive drum 27 outwardly protruding in the axial direction from the side plates 60*a*, 60*b* of the drum cartridge 26 are received by the receiving grooves 99 of the guide portion 97*a*, 97*b* and are guided to the positioning grooves 100 along the receiving grooves 99.

As shown in FIG. 8 (the right side only), when the shaft end portions 68*a*, 68*b* are inserted into the fixing portions 98*a*, 98*b* by overpassing the fixing springs 102, the shaft end portions 68*a*, 68*b* are fixed to the rear edges of the fixing portions 98*a*, 98*b* by the fixing springs 102. Thus, the shaft end portions 68*a*, 68*b* are engaged with the end faces 110 of the rear edges of the fixing portions 98*a*, 98*b*, so that the position of the process unit 17 is set in the front and rear direction and in the up and down direction.

As shown in FIG. 5, in the left guide plate 95*a*, when the shaft end portion 68*a* is inserted into the fixing portion 98*a*, the end face of the shaft end portion 68*a* slides over the inclined surface 106 of the guide portion 97*a* and is guided inward in the width direction. Thus, the end face of the shaft end portion 68*a* is abutted against the recessed surface 109. Accordingly, the positioning of the process unit 17 in the width direction can be achieved.

In this state, when the shaft end portion 68*a* contacting the guide plate 95*a* passes the inclined surface 106 of the guide portion 97*a* and reaches the recessed surface 109 of the fixing portion 98*a*, the shaft end portion 68*a* is pressed inward in the width direction by the recessed surface 109 of the fixing portion 98*a*. Thus, the friction member 111 provided to the shaft end portion 68*b* of the drum shaft 66 elastically contacts the side plate 60*b*, thereby positioning the process unit 17 in the width direction.

In the state where the process unit 17 is attached to the body frame 2, the end face of the shaft end portion 68*b* of the drum shaft 66 contacts the grounding electrode 109*a* of the body frame 2. Therefore, the drum body 65 is electrically connected to the ground via the leaf spring (not shown), the drum shaft 66, and the grounding electrode 109*a*. As described above, the grounding electrode 109*a* includes the wire spring, so that the grounding electrode 109*a* urges the end face of the shaft end portion 68*b* of the drum shaft 66 toward the side plate 60*a*. Accordingly, the drum shaft 66 is surely positioned at the recessed surface 109 of the fixing portion 98*a* of the guide plate 95*a*.

When the process unit 17 is attached to the body frame 2, the cartridge frame 51 does not contact the guide plates 95*a*, 95*b* of the body frame 2 and the predetermined distance can be maintained between the cartridge frame 51 and each guide plate 95*a*, 95*b*. The side plate 60*b* is provided with a feeding electrode (not shown) that feeds power to grid electrodes of the scorotron charging device 29, a feeding electrode (not shown) that feeds power to the charging wires of the scorotron charging device 29, and a feeding electrode (not shown) that feeds power to the transfer roller 30. Only the feeding electrodes contact the electrodes provided to the body frame 2. These feeding electrodes also include wire springs, which urge the cartridge frame 51 toward the side plate 60*a*. With this structure, the cartridge frame 51 is attached to the body frame 2 while the cartridge frame 51 is further prevented from rattling and its positioning accuracy is improved.

In addition, the gear 112 provided to the drum body 65 and the drive gear provided to the body frame 2 are both helical gears, so that an urging force that urges the drum body 65 toward the side plate 60*a* is generated by the engagement of the gear 112 and the drive gear. Therefore, the rattling of the cartridge frame 51 in the detaching direction can be prevented as well as the rattling in the width direction.

The process device may further include a charging device, and the frame may include a lower frame that supports the photosensitive body and an upper frame that is disposed above and is attached to the lower frame and includes the charging device.

With this structure, when the upper frame is attached to the lower frame, the charging device provided to the upper frame can be disposed so as to be opposite to the photosensitive body provided to the lower frame. Therefore, the assembling qualities of the process device can be improved.

In the state where the process unit 17 is attached to the body frame 2, first, the surface of the photosensitive drum 27 is uniformly positively charged by the scorotron charging device 29 in accordance with the rotation of the photosensitive drum 27. Then, the surface of the photosensitive drum 27 is exposed to a laser beam emitted from the scanning portion 16 and an electrostatic latent image is formed onto the surface of the photosensitive drum 27. After that, when the electrostatic latent image on the photosensitive drum 27 faces and contacts the developing roller 31, the positively charged toner held on the developing roller 31 is supplied onto and held by the electrostatic latent image formed on the photosensitive drum 27, i.e., a portion whose potential is lowered by the exposure by the laser beam. Thus, the toner is selectively held by the photosensitive drum 27 and a toner image is formed thereon. Accordingly, a reversal phenomenon is achieved. After that, the toner image held by the surface of the photosensitive drum 27 is transferred onto the sheet 3 while the sheet 3 passes between the photosensitive drum 27 and the transfer roller 30, by a transfer bias applied to the transfer roller 30.

As shown in FIG. 1, the fixing portion 18 is provided downstream and at the side of the process unit 17 in the sheet conveying direction. The fixing portion 18 includes a heat roller 41, a pressing roller 42 that presses the heat roller 41, and a pair of conveyor rollers 43 that are provided downstream of the heat roller 41 and the pressing roller 42 in the sheet conveying direction. In an exemplary embodiment, the heat roller 41 is made of metal and has a halogen lamp to generate heat. The heat roller 41 is driven by the power from the motor (not shown) to rotate (clockwise) in a direction indicated by an arrow of FIG. 1. The pressing roller 42 rotates (counterclockwise) in a direction indicated by an arrow by following the rotation of the heat roller 41 while pressing the heat roller 41. In the fixing portion 18, the toner transferred onto the sheet 3 by the process unit 17 is thermally fixed onto the sheet 3 while the sheet 3 passes between the heat roller 41 and the pressing roller 42, and then the conveyor rollers 43 convey the sheet 3 to a sheet discharge path 44. The sheet 3 conveyed to the sheet discharge path 44 is conveyed to a pair of sheet discharge rollers 45 and is discharged onto a sheet discharge tray 46 by the sheet discharge rollers 45.

The laser beam printer 1 is provided with a reverse conveying portion 47 in order to form images onto both sides of the sheet 3. The reverse conveying portion 47 includes the pair of discharge rollers 45, a reverse conveying path 48, a flapper 49, and a plurality pairs of reverse conveyor rollers 50.

The pair of sheet discharge rollers 45 are designed such that their rotating direction can be switched between a normal direction and a reverse direction. As described above, the sheet discharge rollers 45 rotate in the normal direction in order to discharge the sheet 3 onto the sheet discharge tray 46 and rotate in the reverse direction in order to turn the sheet 3 upside down.

The reverse conveying path 48 is provided extending in the up and down direction so that the reverse conveying path 48 can convey the sheet 3 from the sheet discharge rollers 45 to the plurality pairs of the reverse conveyor rollers 50 provided below the transfer position. An upstream end portion of the reverse conveying path 48 is provided near the sheet discharge rollers 45 and its downstream end portion is provided near the reverse conveyor rollers 50.

The flapper 49 is pivotably provided at a branch point between the sheet discharge path 44 and the reverse conveying path 48. By exciting and non-exciting a solenoid (not shown), the sheet conveying direction reversed by the sheet discharge rollers 45 can be switched from the direction toward the sheet discharge path 44 to the direction toward the reverse conveying path 48.

The pairs of the reverse conveyor rollers 50 are aligned substantially in the horizontal direction above the sheet feeding tray 6. The most upstream pair of reverse conveyor rollers 50 are located near the downstream end portion of the reverse conveying path 48 and the most downstream pair of reverse conveyor rollers 50 are located below the resist rollers 12.

To form images on both surfaces of a sheet 3, the reverse conveying portion 47 is operated as described below. When a sheet 3 having an image on its one surface is fed to the sheet discharge rollers 45 by the conveyor rollers 43 through the sheet discharge path 44, the sheet discharge rollers 45 rotate in the normal direction with pinching the sheet 3 therebetween in order to convey the sheet 3 to the outside of the laser beam printer 1 once (toward the sheet discharge tray 46 side), so that the most part of the sheet 3 is discharged to the outside. Then, the sheet discharge rollers 45 stop rotating in the normal direction when pinching the trailing edge of the sheet 3. Next, the sheet discharge rollers 45 rotate in the reverse direction and the flapper 49 switches the sheet conveying direction so that the sheet 3 is conveyed to the reverse conveying path 48 with its conveying direction being reversed. When the conveyance of the sheet 3 is finished, the flapper 49 is switched to an original position, i.e., a position where the sheet 3 fed from the conveyor rollers 43 is conveyed to the sheet discharge rollers 45. Then, the sheet 3 fed to the reverse conveying path 48 with its conveying direction being reversed is further conveyed to the reverse conveyor rollers 50. The sheet 3 is reversed so that the surface having the image faces down after the sheet 3 passes the sheet conveyor rollers 50, and is further conveyed to the resist rollers 12. After the resist rollers 12 resist the sheet 3 again, the sheet 3 is further conveyed to the image forming position with upside down and an image is formed on the reverse side of the sheet 3. Then, finally, the images are formed on the both surfaces of the sheet 3.

In the laser beam printer 1, as described above, the shaft end portions 68*a*, 68*b* of the drum shaft 66 are guided by the guide portions 97*a*, 97*b* of the guide plates 95*a*, 95*b* of the body frame 2 and then fixed at the respective fixing portions 98*a*, 98*b* when the process unit 17 is attached to the body frame 2. In the state where the shaft end portions 68*a*, 68*b* of the drum shaft 66 are fixed at the fixing portions 98*a*, 98*b*, the positioning of the process unit 17 in the front and rear direction and in the up and down direction with respect to the body frame 2 is achieved by the engagement of the shaft end portions 68*a*, 68*b* of the metal drum shaft 66 and the end faces 110 of the fixing portions 98*a*, 98*b*. Further, the positioning of the process unit 17 in the width direction is achieved by the abutment of the shaft end portion 68*a* against the recessed surface 109 of the guide plate 95*a*. Accordingly, the process unit 17 can be positioned with respect to the body frame 2 without the cartridge frame 51 of the drum cartridge 26 being contacted to the body frame 2. Therefore, damage to the cartridge frame 51 can be prevented when the process unit 17 is attached to and detached from the body frame 2 and the accurate positioning of the process unit 17 can be achieved.

When the process unit 17 is attached to the body frame 2, the shaft end portion 68*a* of the drum shaft 66 is guided along the inclined surface 106, which is inclined inward from the front to the rear, in the guide portion 97*a*. Therefore, the process unit 17 can be smoothly attached to the body frame 2.

The shaft end portions 68*a*, 68*b* of the metal drum shaft 66 outwardly protrude in the axial direction of the drum shaft 66 from the side plates 60*a*, 60*b* of the cartridge frame 51, so that the drum shaft 66 can be firmly positioned on the both sides. In the process unit 17, the shaft end portions 68*a*, 68*b* of the metal drum shaft 66 also serve as the positioning members, so that a parts count can be reduced and the structure of the laser beam printer 1 can be simplified. In the process unit 17, the end face of the shaft end portion 68*b* of the drum shaft 66 contacts the grounding electrode 109*a* of the body frame 2 and is electrically connected to the ground in the state where the process unit 17 is attached to the body frame 2. Therefore, an electrostatic latent image can be stably formed onto the photosensitive drum 27.

In the cartridge frame 51 of the drum cartridge 26, the scorotron charging device 29 provided in the upper frame 53 can be disposed opposite to the photosensitive drum 27 provided in the lower frame 52 when the upper frame 53 is attached to the lower frame 52. Accordingly, an assembling accuracy of the process unit 17 can be improved.

In the cartridge frame 51 of the drum cartridge 26, the assembling of the upper frame 53 to the lower frame 52 is achieved by which the upper frame 53 is engaged with the lower frame 52 by overlapping the protrusions 83 of the upper engaging portions 81 and the protrusions 71 of the lower engaging portions 69. The disassembling of the upper frame 53 from the lower frame 52 is achieved by the protrusions 83 of the upper engaging portions 81 are disengaged from the protrusions 71 of the lower engaging portions 69. By doing so, the upper frame 53 and the lower frame 52 can be easily assembled to and disassembled from each other.

The protrusions 83 of the upper engaging portions 81 and the protrusions 71 of the lower engaging portions 69 overlap with each other in the front and rear direction, that is, in the direction to attach the drum cartridge 26. Therefore, the displacement of the upper frame 53 and the lower frame 52 from each other in the drum cartridge attaching direction can be prevented.

As described above, the upper frame 53 and the lower frame 52 are engaged with each other by overlapping the protrusions 83 of the upper engaging portions 81 and the protrusions 71 of the lower engaging portion 69, so that the upper frame 53 and the lower frame 52 can be firmly engaged with each other.

In the drum cartridge 26, the protrusions 71 of the lower engaging portions 69 and the protrusions 83 of the upper engaging portions 81 overlap with each other, on the both sides in the width direction. Therefore, the upper frame 53 and the lower frame 52 can be firmly engaged with each other.

The protrusions 71 of the lower engaging portions 69 can overlap with the protrusions 83 of the upper engaging portions 81 at the front of the drum cartridge 26, so that the upper frame 53 and the lower frame 52 can be engaged with each other at the front of the drum cartridge 26. Further, in the drum cartridge 26, the lower frame 52 and the upper frame 53 are fixed by the shoulder screws 88 at the rear of the drum cartridge 26. Therefore, the upper frame 53 and the lower frame 52 can be engaged with each other at the both sides of the drum cartridge 26 in the front and rear direction.

The upper frame 53 and the lower frame 52 are fixed to each other by which the protrusions 71 of the lower engaging portions 69 of the lower frame 52 are engaged with the protrusions 83 of the upper engaging portions 81 of the upper frame 53 at the front, and in addition, the upper frame 53 can be positioned with respect to the lower frame 52 by using the shoulder screws 88 at the rear. Therefore, the highly accurate assembling can be achieved. Further, the shoulder screws 88 are positioned with substantially no play with their shoulder portions 91 being received in the respective receiving holes 87. Accordingly, the accurate screw fastening can be achieved.

In the state where the upper frame 53 is assembled to the lower frame 52, the overlap portions 92 are defined by which the rear walls of the screw fastening portions 72 of the lower frame 52 and the rear plate 79 of the upper frame 53 overlap each other in the front and rear direction. With this structure, the positioning between the lower frame 52 and the upper frame 53 at the rear of the drum cartridge 26 and the prevention of foreign matter from entering the drum cartridge 26 between the upper frame 53 and the lower frame 52 can be achieved.

The assembling of the upper frame 53 of the drum cartridge 26 to the lower frame 52 is achieved by contacting the upper surfaces of the protrusions 83 of the upper engaging portions 81 of the upper frame 53 with the lower surfaces of the protrusions 71 of the respective lower engaging portions 69 of the lower frame 52. Then, the upper frame 53 is rotated with respect to the lower frame 52 about the contacting portion. After that, the upper frame 53 and the lower frame 52 are engaged with and fixedly attached to each other by the shoulder screws 88. Thus, the assembling of the upper frame 53 to the lower frame 52 can be easily and smoothly performed.

In the upper frame 53, the pairs of regulating plates 85, which are provided so as to pinch the respective vertical bar portions 82 of the upper engaging portions 81 therebetween, regulate the movement of the vertical plate protrusions 71 of the lower frame 52 in the width direction. Accordingly, the protrusions 71 of the lower engaging portions 69 and the upper engaging protrusions 83 of the upper engaging portions 81, which are engaged with each other, can be prevented from displacing in the width direction when the upper frame 53 is assembled to the lower frame 52. Thus, the upper frame 53 can be smoothly assembled to the lower frame 52. The regulating plates 85 may be provided to the lower frame 52 in order to regulate the movement of the protrusions 83 of the upper frame 53 in the width direction.

In the drum cartridge 26, the photosensitive drum 27 is supported by the lower frame 52 and the scorotron charging device 29 is supported by the upper frame 53. Therefore, the photosensitive drum 27 can be firmly supported by the lower frame 52 and the scorotron charging device 29 can be assembled to the drum cartridge 26 by which the upper frame 53 is assembled to the lower frame 52.

Figure 9:
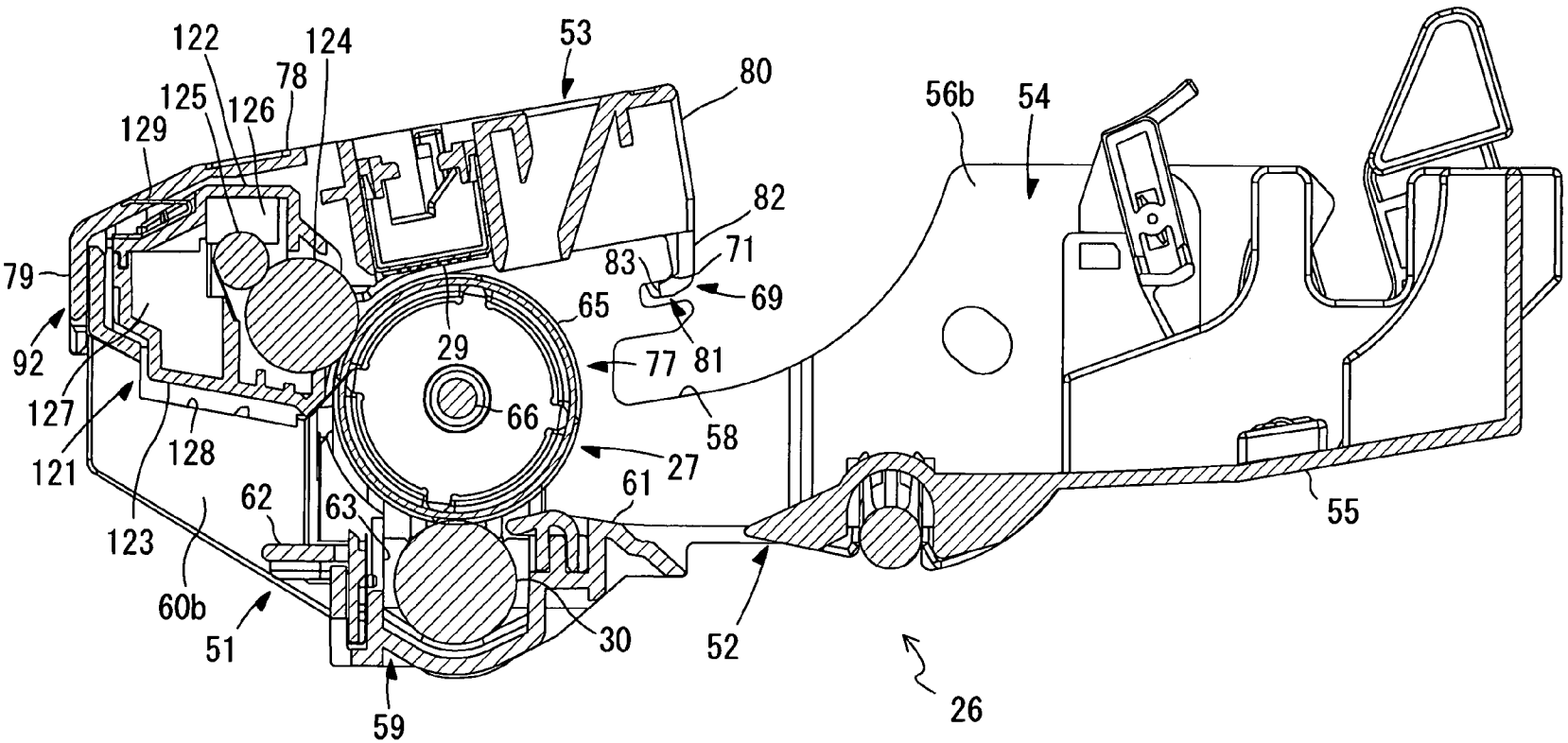
FIG. 9 is a sectional view showing essential parts of a drum cartridge of another embodiment of the invention where the drum cartridge includes a cleaning unit.
Figure 10:
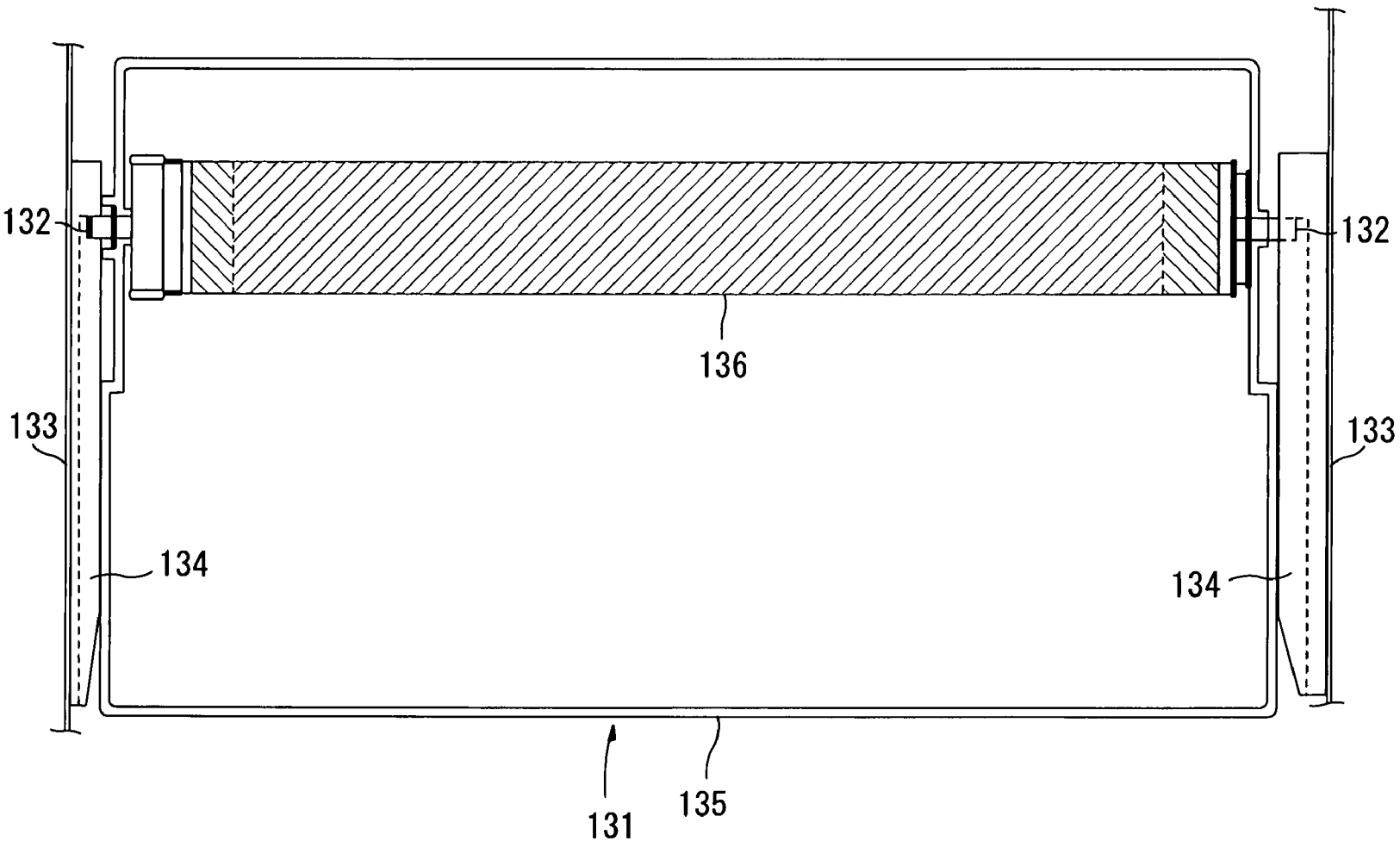
PRIOR ART FIG.10
FIG. 10 is a sectional plan view showing a body frame of a laser beam printer in a state where a conventional drum cartridge is attached to the body frame.

In the above embodiment, the description has been made with the drum cartridge 26 having the cleaning brush 64 as an example. However, the drum cartridge 26 may include, for example, a cleaning unit 121, instead of the cleaning brush 64, as shown in FIG. 9. In FIG. 9, the same parts are designated with the similar numerals as the above embodiment and explanations for those parts will be omitted.

A drum cartridge 26 of FIG. 9 includes a cartridge frame 51, a photosensitive drum 27 that is provided in the cartridge frame 51, a scorotron charging device 29, a transfer roller 30, and the cleaning unit 121 instead of the cleaning brush 64. The cartridge frame 51 also includes a lower frame 52 and an upper frame 53 as with the above embodiment.

The lower frame 52 also includes a cartridge accommodating portion 54 that accommodates a developing cartridge 28 and a drum accommodating portion 77 that accommodates the photosensitive drum 27 and the transfer roller 30. The cartridge accommodating portion 54 and the drum accommodating portion 77 are integral with each other. As described above, the developing cartridge 28 is accommodated in the cartridge accommodating portion 54 (this condition is not shown), and the photosensitive drum 27 and the transfer roller 30 are supported in the drum accommodating portion 77.

A lower engaging portion 69 is provided to an upper front end portion of each side plate 60*a*, 60*b* of the drum accommodating portion 77 in order to engage the upper frame 53. Each lower engaging portion 69 has a substantially C-shape extending in the front and rear direction and its front part is cut away. Each lower engaging portion 69 includes a vertical plate protrusion 71 at its upper portion.

A screw fastening portion (not shown) is provided at the upper rear end portion of each side plate 60. The screw fastening portions protrude toward inward in the width direction of the drum accommodating portion 72.

The cleaning unit 121 is provided at the rear part of the lower frame 52. The cleaning unit 121 includes an upper cleaning frame 122, a lower cleaning frame 123, a first cleaning roller 124, a second cleaning roller 125, a sponge scraper 126, and a paper dust storage portion 127.

A cleaning unit holding plate 128 is provided at the rear part of the lower frame 52 in order to support the lower cleaning frame 123. The lower cleaning frame 123 is supported by an upper surface of the lower cleaning frame 123. The upper cleaning frame 122 is assembled to the lower cleaning frame 123 so as to cover the lower cleaning frame 123 supported by the cleaning unit holding plate 128, from above.

The first cleaning roller 124 is rotatably supported by the lower cleaning frame 123, behind the photosensitive drum 27, so as to opposingly contact the photosensitive drum 27. A first cleaning bias is applied to the first cleaning roller 124. The second cleaning roller 125 is rotatably supported by the lower cleaning frame 123, behind the first cleaning roller 124, so as to opposingly contact the first cleaning roller 124. A second cleaning bias is applied to the second cleaning roller 125. The sponge scraper 126 is affixed to the upper cleaning frame 122, above the second claiming roller 125, so as to opposingly contact the second cleaning roller 125. The paper dust storage portion 127 is an enclosed space defined by the upper cleaning frame 122 and the lower cleaning frame 123 provided behind the second cleaning roller 125.

In the cleaning unit 121, when an image is transferred onto a sheet 3, a negative bias which is lower than a potential of the surface of the photosensitive drum 27 is applied to the first cleaning roller 124 in order to attract toner adhering to the photosensitive drum 27 to the first cleaning roller 124. Then, the toner remaining on the photosensitive drum 27 is temporarily collected by the first cleaning roller 124.

When toner is not transferred onto the sheet 3, that is, the interval from which a sheet 3 passes the transfer position and a next sheet 3 reaches the transfer position, a positive bias which is higher than the potential of the surface of the photosensitive drum 27 is applied to the first cleaning roller 124 in order to attract paper dust adhering to the photosensitive drum 27 to the first cleaning roller 124. Then, the toner temporarily collected by the first cleaning roller 124 is fed back to the photosensitive drum 27 and paper dust that adhered to the photosensitive drum 27 from the sheet 3 at the transferring is collected by the first cleaning roller 124. The toner fed back to the photosensitive drum 27 is then collected by the developing roller 31.

The paper dust collected by the first cleaning roller 124 is electrically collected by the second cleaning roller 125 at all times when opposingly contacting the second cleaning roller 125. The paper dust collected by the second cleaning roller 125 is then wiped by the sponge scraper 126 when opposingly contacting the sponge scraper 126, and is stored in the paper dust storage portion 127.

In the cleaning unit 121, residual toner and paper dust adhering to the photosensitive drum 27 are electrically attracted by the first cleaning roller 124. While the toner attracted by the first cleaning roller 124 is electrically fed back to the photosensitive drum 27, the paper dust attracted by the first cleaning roller 124 is electrically attracted and collected by the second cleaning roller 125. Thus, by the above cleanerless developing system, paper dust can be effectively removed from the photosensitive drum 27 concurrently with the collection of residual toner, thereby improving the paper dust removing performance.

The upper frame 53 includes an upper plate 78 that covers the upper portion of the drum accommodating portion 77 provided in the lower frame 52, a rear plate 79 that extends downward from a rear edge of the upper plate 78, a front plate 80 that extends downward from a front edge of the upper plate 78. The upper plate 78, the rear plate 79, and the front plate 80 are integral with each other. The scorotron charging device 29 is provided at the middle in the front and rear direction of the upper plate 78 so as to extend in the width direction of the upper plate 78 and be opposite to the photosensitive drum 27 at a predetermined distance away from each other.

An upper engaging portion 81 is provided to each side of the front end of the upper plate 78 in the width direction. Each upper engaging portion 81 has a substantially L-shape, and includes a vertical bar portion 82 that extends downward along the front plate 80 and an upper engaging protrusion 83 that extends downwardly rearward in a slanting direction from near the lower end portion of the vertical bar portion 82. The vertical bar portion 82 and the protrusion 83 are integral with each other.

A screw mounting portion (not shown) is provided to the each side of the rear end of the upper plate 78 in the width direction.

To assemble the upper frame 53 to the lower frame 52, at the front, the upper surfaces of the upper engaging protrusions 83 of the upper engaging portions 81 of the upper frame 53 are contacted with the lower surfaces (corners) of the vertical plate protrusions 71 of the respective lower engaging portions 69 of the lower frame 52. In this state, the upper frame 53 is rotated with respect to the lower frame 52 about the contacting portion. After that, at the rear, the screw fastening portions of the lower frame 52 are opposingly aligned with the respective screw mounting portions of the upper frame 53 and the upper frame 53 and the lower frame 52 are fixed by screws. Thus, the assembling of the upper frame 53 to the lower frame 52 is achieved.

In the state where the upper frame 53 is assembled to the lower frame 52, the lower surfaces of the protrusions 71 of the lower engaging portions 69 of the lower frame 52 do not contact horizontally the upper surfaces of the protrusions 83 of the upper engaging portions 83 of the upper frame 53. That is, the upper surfaces of the protrusions 83 of the upper engaging portions 81 of the upper frame 53 slantingly contact the respective corners of the lower surfaces of the protrusions 71 of the lower engaging portions 69.

A spring 129 contacting the upper frame 53 is provided to the upper cleaning frame 122 of the cleaning unit 121. The spring 129 abuts against the upper frame 53 to urge the protrusions 83 of the upper engaging portions 69 of the upper frame 53 by contacting the upper frame 53, upwardly rearward in a slanting direction. With this structure, when the upper frame 53 is assembled to the lower frame 52, the upper frame 53 can be fixedly attached to the lower frame 52 by the screws while rattling caused between the protrusions 71 of the lower engaging portions 69 and the protrusions 83 of the upper engaging portions 83 is reduced by the urging force from the spring 129.

In the drum cartridge 26 of FIG. 2, the upper frame 53 and the lower frame 52 are precisely fixed to each other by the shoulder screws 88. However, in the drum cartridge 26 of FIG. 9, the upper frame 53 is urged downwardly rearward in the slanting direction by the spring 129, so that the positioning of the upper frame 53 and the lower frame 52 can be achieved by the urging force from the spring 129. Accordingly, the shoulder screws 88 of FIG. 2 (special screws) are not necessary to be used in the drum cartridge 26 of FIG. 9.

In the drum cartridge 26 of FIG. 9, the assembling of the upper frame 53 to the lower frame 52 is achieved by which the upper frame 53 is engaged with the lower frame 52 by overlapping the protrusions 83 of the upper engaging portions 81 and the protrusions 71 of the lower engaging portions 69. The disassembling of the upper frame 53 from the lower frame 52 is achieved by the protrusions 83 of the upper engaging portions 81 are disengaged from the protrusions 71 of the lower engaging portions 69. By doing so, the upper frame 53 and the lower frame 52 can be easily assembled to and disassembled from each other.

According to one aspect of the invention, a process device detachably attachable to a body of an image forming apparatus, includes a frame, a photosensitive body, and a positioning member that is made of metal and protrudes outward in a direction parallel to a longitudinal direction of the photosensitive body from at least one side of the frame. The positioning member positions an attached position of the process device in a direction to attach the process device and in a direction perpendicular to the attaching direction, with respect to the image forming apparatus body, when the process device is attached to the image forming apparatus body.

According to the above structure, the position of the process device in the process device attaching direction and in the direction perpendicular to the attaching direction is set by the metal positioning member provided to the process device, with respect to the image forming apparatus body. Therefore, the process device can be positioned with respect to the image forming apparatus body without a frame of the process device being contacted with the image forming apparatus body. As a result, the frame of the process device is prevented from being damaged when the process device is attached to and detached from the image forming apparatus body, and the accurate positioning of the process device can be achieved.

The positioning member may protrude from both sides of the frame so as to extend in the direction parallel to the longitudinal direction of the photosensitive body.

According to the above structure, the positioning member protrudes from both sides of the frame so as to extend in the direction parallel to the longitudinal direction of the photosensitive body. Therefore, the process device can be surely positioned on the both sides of the frame.

According to a further aspect of the invention, an image forming apparatus includes a process device detachably attachable to a body of the image forming apparatus. The process device includes a frame, a photosensitive body, and a positioning member that is made metal and protrudes outward in a direction parallel to a longitudinal direction of the photosensitive body from at least one side of the frame. The positioning member positions an attached position of the process device in a direction to attach the process device and in a direction perpendicular to the attaching direction, with respect to the image forming apparatus body, when the process device is attached to the image forming apparatus body. The image forming apparatus body includes a contacting member against which the positioning member abuts. The contacting member includes a fixing portion that fixes the positioning member at the attached position of the process device with respect to the image forming apparatus body, in the attaching direction and in the direction perpendicular to the attaching direction, and a guide portion that is disposed upstream of the fixing portion in the attaching direction and disposed at a position more outside than a position where the fixing portion is present in a direction parallel to the longitudinal direction of the photosensitive body.

According to the above structure, the positioning member of the process device is guided by the guide portion of the contacting member of the image forming apparatus and then fixed at the fixing portion of the contacting member while the position of the process device is set with respect to the attaching direction and in the direction perpendicular to the attaching direction. Therefore, the process device can be positioned with respect to the image forming apparatus body without a frame of the process device being contacted with the image forming apparatus body. As a result, the frame of the process device is hardly damaged when the process device is attached to and detached from the image forming apparatus body, and the accurate positioning of the process device can be achieved.

The guide portion may include an inclined surface that is inwardly inclined in a direction parallel to the longitudinal direction of the photosensitive drum, toward the fixing portion, from upstream to downstream in the attaching direction.

According to the above structure, when the process device is attached to the image forming apparatus body, the positioning member of the process device is guided along the inclined surface that is inwardly inclined in the direction parallel to the longitudinal direction of the photosensitive drum, toward the downstream from the upstream in the attaching direction, at the guiding portion of the contacting portion of the image forming apparatus body. Therefore, the smooth attaching of the process device with respect to the image forming apparatus body can be achieved.

According to another aspect of the invention, the positioning member protrudes from both sides of the frame so as to extend in a direction parallel to the longitudinal direction of the photosensitive body.

The positioning member protrude from both sides of the frame so as to extend in the direction parallel to the longitudinal direction of the photosensitive body. Therefore, the process device can be surely positioned on the both sides.

The photosensitive body may include a shaft rotatably supported by the frame, wherein one end of the shaft may function as the positioning member.

According to the above structure the one end of the shaft functions as the positioning member, so that a parts count can be reduced and the structure of the image forming apparatus can be simplified.

The other end of the shaft may be electrically connected to a ground when the process device is attached to the image forming apparatus body.

According to the above structure, the other end of the shaft is electrically connected to the ground when the process device is attached to the image forming apparatus, so that an electrostatic latent image can be stably formed onto the photosensitive body.

While the invention has been described in detail with reference to the specific embodiments thereof, it would be apparent to those skilled in the art that various changes, arrangements and modifications may be applied therein without departing from the spirit and scope of the invention.

What is claimed is:

1. A photosensitive body cartridge detachably attachable to a body of an image forming apparatus, comprising:

a photosensitive body;

a lower frame; and an upper frame that is disposed above the lower frame and is attachable to the lower frame, wherein the upper frame includes an upper engaging portion that engages the lower frame and the lower frame includes a lower engaging portion that engages the upper frame, and the upper engaging portion and the lower engaging portion extend in directions opposite to each other in a state where the upper frame is attached to the lower frame, and when the upper frame and the lower frame are engaged with each other, the upper engaging portion and the lower engaging portion overlap each other.

2. The photosensitive body cartridge according to claim 1, wherein the upper engaging portion and the lower engaging portion extend in a direction parallel to a direction to attach the photosensitive body cartridge when the upper frame is attached to the lower frame.

3. The photosensitive body cartridge according to claim 2, wherein the upper engaging portion has a protrusion integrated therewith, the lower engaging portion has a protrusion integrated therewith, and when the upper frame and the lower frame are engaged with each other, the protrusion of the upper engaging portion and the protrusion of the lower engaging portion overlap each other.

4. The photosensitive body cartridge according to claim 3, wherein the lower frame is provided with the protrusion at each side in the longitudinal direction of the photosensitive body and the upper frame is provided with the protrusion at a position corresponding to each of the protrusions of the lower frame.

5. The photosensitive body cartridge according to claim 3, wherein the protrusions of the lower and upper frames are provided at one side of the photosensitive body cartridge in a direction perpendicular to the longitudinal direction of the photosensitive body.

6. The photosensitive body cartridge according to claim 5, wherein the lower frame and the upper frame are fixed to each other by a screw, at the other side of the photosensitive body cartridge in the direction perpendicular to in the longitudinal direction of the photosensitive body.

7. The photosensitive body cartridge according to claim 6, wherein the screw includes a head portion to which a rotating force is applied, a threaded portion that is provided with threads, and a shoulder portion that is provided between the head portion and the threaded portion and has a diameter which is larger than that of the threaded portion and is smaller than that of the head portion, and wherein one of the lower frame and the upper frame is provided with a receiving portion that receives the shoulder portion and has the substantially same diameter as the shoulder portion and the other of the lower frame and the upper frame is provided with a screwed portion into which the threaded portion is screwed.

8. The photosensitive body cartridge according to claim 5, further comprising an overlap portion that is defined by the lower frame and the upper frame at the other side of the photosensitive body cartridge in the direction perpendicular to the longitudinal direction of the photosensitive body, wherein the lower frame and the upper frame overlap each other in the direction perpendicular to the longitudinal direction of the photosensitive body.

9. The photosensitive body cartridge according to claim 5, wherein the lower frame and the upper frame are opposite each other at the other side of the photosensitive body cartridge, in the direction perpendicular to the longitudinal direction of the photosensitive body, by which the upper frame is rotated with respect to the lower frame about a contacting portion where a lower surface of the protrusion of the lower frame and an upper surface of the protrusion of the upper frame are contacted with each other.

10. The photosensitive body cartridge according to claim 4, wherein at least one of the upper frame and the lower frame is provided with a regulating portion that regulates movement of the protrusion of the lower frame or the upper frame in a direction parallel to the longitudinal direction of the photosensitive body.

11. The photosensitive body cartridge according to claim 1, wherein the photosensitive drum is supported by the lower frame.

12. The photosensitive body cartridge according to claim 1, further comprising a charging device, the charging device being supported by the upper frame.

13. The photosensitive body cartridge according to claim 12, wherein the lower frame includes a cleaning unit that accommodates a cleaning member for cleaning the photosensitive body, and the cleaning unit includes an urging member that applies an urging force to the upper frame.

14. An image forming apparatus, comprising:

a process device that is detachably attached to a body of the image forming apparatus, the process device including:

a photosensitive body cartridge that is detachably attachable to the body of the image forming apparatus and includes a photosensitive body; and a developing agent cartridge that is detachably attachable to the photosensitive body cartridge and includes a developing agent holding member;

the photosensitive body cartridge including:

a lower frame; and an upper frame that is disposed above the lower frame and attachable to the lower frame, wherein the upper frame includes an upper engaging portion that engages the lower frame and the lower frame includes a lower engaging portion that engages the upper frame, the upper engaging portion and the lower engaging portion include protrusions that extend in directions opposite to each other in a state where the upper frame is attached to the lower frame, and when the upper frame and the lower frame are engaged with each other the protrusions of the upper engaging portion and the protrusion of the lower engaging portion overlap each other.

15. A method of assembling a photosensitive body cartridge that is detachably attachable to a body of an image forming apparatus and includes a photosensitive body, wherein the photosensitive body cartridge includes a lower frame and an upper frame that is disposed above and is attached to the lower frame, the upper frame includes an upper engaging portion engaging the lower frame, the lower frame includes a lower engaging portion engaging the upper frame, and the upper frame and the lower frame include protrusions that extend in directions opposite to each other in a state where the upper frame is attached to the lower frame and engage the upper frame with the lower frame by overlapping each other, the method comprising:

contacting a lower surface of the protrusion of the lower frame with an upper surface of the protrusion of the upper frame;

rotating the upper frame with respect to the lower frame about a contacting portion where the lower surface of the protrusion of the lower frame contacts the upper surface of the protrusion of the upper frame; and engaging the upper frame with the lower frame at one side of the photosensitive body cartridge in a direction perpendicular to a longitudinal direction the photosensitive body.

16. The method of assembling the photosensitive body cartridge according to claim 15, wherein engaging the upper frame with the lower frame includes through the use of the protrusions provided to the other side of the photosensitive body cartridge in a direction perpendicular to the longitudinal direction of the photosensitive body.

17. The method of assembling the photosensitive body cartridge according to claim 16, further comprising fixing the lower frame and the upper frame to each other by a screw at the one side of the photosensitive body cartridge in the direction perpendicular to the longitudinal direction of the photosensitive body.

18. The method of assembling the photosensitive body cartridge according to claim 17, wherein fixing the upper frame and the lower frame to each other is accomplished by the engagement of the protrusion of the lower frame and the protrusion of the upper frame and the upper frame is positioned with respect to the lower frame by the screw.

19. A process device detachably attachable to a body of an image forming apparatus, comprising:

a frame;

a photosensitive body; and a positioning member that protrudes outward in a direction parallel to a longitudinal direction of the photosensitive body from at least one side of the frame, wherein the positioning member positions an attached position of the process device in a direction to attach the process device and in a direction perpendicular to the attaching direction, with respect to the image forming apparatus body, when the process device is attached to the image forming apparatus body.

20. The process device according to claim 19, wherein the positioning member protrudes from both sides of the frame so as to extend in the direction parallel to the longitudinal direction of the photosensitive body.

21. The process device according to claim 20, wherein the photosensitive body includes a shaft rotatably supported by the frame, and one end of the shaft functions as the positioning member.

22. The process device according to claim 21, wherein the other end of the shaft is electrically connected to a ground when the process device is attached to the image forming apparatus body.

23. The process device according to claim 19, further comprising a charging device, wherein the frame includes a lower frame that supports the photosensitive body and an upper frame that is disposed above and is attached to the lower frame and includes the charging device.

24. An image forming apparatus, comprising:

a process device detachably attachable to a body of the image forming apparatus, the process device including:

a frame;

a photosensitive body; and a positioning member that protrudes outward in a direction parallel to a longitudinal direction of the photosensitive body from at least one side of the frame, wherein the positioning member positions an attached position of the process device in a direction to attach the process device and in a direction perpendicular to the attaching direction, with respect to the image forming apparatus body, when the process device is attached to the image forming apparatus body;

the image forming apparatus body including a contacting member against which the positioning member abuts;

the contacting member including:

a fixing portion that fixes the positioning member at the attached position of the process device with respect to the image forming apparatus body, in the attaching direction and in the direction perpendicular to the attaching direction; and a guide portion that is disposed upstream of the fixing portion in the attaching direction and disposed at a position distal to a position where the fixing portion is present in a direction parallel to the longitudinal direction of the photosensitive body.

25. The image forming apparatus according to claim 24, wherein the guide portion includes an inclined surface that is inwardly inclined in the direction parallel to the longitudinal direction of the photosensitive drum, toward the fixing portion, from upstream to downstream in the attaching direction.

26. The image forming apparatus according to claim 24, wherein the positioning member protrudes from both sides of the frame so as to extend in the direction parallel to the longitudinal direction of the photosensitive body.

27. The image forming apparatus according to claim 26, wherein the photosensitive body includes a shaft rotatably supported by the frame, and one end of the shaft functions as the positioning member.

28. The image forming apparatus according to claim 27, wherein the other end of the shaft is electrically connected to a ground when the process device is attached to the image forming apparatus body.

29. The image forming apparatus according to claim 19, wherein the positioning member is made of metal.

30. The image forming apparatus according to claim 24, wherein the positioning member is made of metal.

* * * * *